US010674287B2

(12) United States Patent
Leigh et al.

(10) Patent No.: US 10,674,287 B2
(45) Date of Patent: Jun. 2, 2020

(54) MAGNET PLACEMENT AND ANTENNA PLACEMENT OF AN IMPLANT

(71) Applicants: Charles Roger Aaron Leigh, Macquarie University (AU); Grahame Michael David Walling, Macquarie University (AU)

(72) Inventors: Charles Roger Aaron Leigh, Macquarie University (AU); Grahame Michael David Walling, Macquarie University (AU)

(73) Assignee: Cochlear Limited, Macquarie University, NSW (AU)

( * ) Notice: Subject to any disclaimer, the term of this patent is extended or adjusted under 35 U.S.C. 154(b) by 548 days.

(21) Appl. No.: 15/359,666

(22) Filed: Nov. 23, 2016

(65) Prior Publication Data

US 2018/0146308 A1 May 24, 2018

(51) Int. Cl.
*H04R 25/00* (2006.01)

(52) U.S. Cl.
CPC ..... *H04R 25/554* (2013.01); *H04R 25/60* (2013.01); *H04R 2225/51* (2013.01); *H04R 2225/67* (2013.01)

(58) Field of Classification Search
CPC .. H04R 25/554; H04R 25/60; H04R 2225/51; H04R 2225/67
USPC ..... 381/326
See application file for complete search history.

(56) References Cited

U.S. PATENT DOCUMENTS

| | | | | |
|---|---|---|---|---|
| 6,348,070 | B1 | 2/2002 | Teissl et al. | |
| 6,838,963 | B2 | 1/2005 | Zimmerling et al. | |
| 7,091,806 | B2 | 8/2006 | Zimmerling et al. | |
| 7,642,887 | B2 | 1/2010 | Zimmerling | |
| 8,340,774 | B2 | 12/2012 | Hochmair et al. | |
| 8,634,909 | B2 | 1/2014 | Zimmerling et al. | |
| 8,733,494 | B1 | 5/2014 | Leigh | |
| 9,144,676 | B2 | 9/2015 | Gibson et al. | |
| 2004/0012470 | A1* | 1/2004 | Zimmerling | A61N 1/37 335/207 |
| 2005/0062567 | A1 | 3/2005 | Zimmerling et al. | |
| 2005/0159791 | A1* | 7/2005 | Daly | H04R 25/606 607/57 |
| 2007/0126540 | A1 | 6/2007 | Zimmerling | |
| 2008/0221641 | A1 | 9/2008 | Hochmair et al. | |
| 2009/0005836 | A1* | 1/2009 | Chang | A61N 1/0541 607/57 |
| 2009/0099403 | A1 | 4/2009 | Zimmerling et al. | |
| 2009/0216324 | A1* | 8/2009 | Leigh | A61N 1/0541 623/10 |

(Continued)

FOREIGN PATENT DOCUMENTS

| | | | |
|---|---|---|---|
| WO | 03092326 | A1 | 11/2003 |
| WO | 2010000026 | A1 | 1/2010 |
| WO | 2008089505 | A1 | 8/2011 |

*Primary Examiner* — Sean H Nguyen
(74) *Attorney, Agent, or Firm* — Pilloff Passino & Cosenza LLP; Martin J. Cosenza

(57) ABSTRACT

An implantable medical device, such as a cochlear implant, a bone conduction device or a middle ear implant, including a magnet, and an electromagnetic communication wire forming, with respect to two dimensions, an enclosed boundary, wherein the magnet is located outside of the enclosed boundary. In an exemplary embodiment, the magnet is located in a container, and can revolve within the container.

16 Claims, 42 Drawing Sheets

(56) References Cited

U.S. PATENT DOCUMENTS

| | | | | |
|---|---|---|---|---|
| 2011/0022120 | A1 | 1/2011 | Ball et al. | |
| 2011/0070747 | A1 | 3/2011 | Ball | |
| 2011/0216927 | A1 | 9/2011 | Ball | |
| 2012/0172659 | A1 | 7/2012 | Ball et al. | |
| 2012/0197345 | A1 | 8/2012 | Staller | |
| 2012/0238799 | A1 | 9/2012 | Ball et al. | |
| 2012/0296155 | A1* | 11/2012 | Ball | A61N 1/3718 600/25 |
| 2013/0165738 | A1* | 6/2013 | Ball | H04R 25/02 600/25 |
| 2014/0012349 | A1 | 1/2014 | Zimmerling | |
| 2015/0087892 | A1 | 3/2015 | Tourrel et al. | |
| 2015/0382115 | A1* | 12/2015 | Meskens | H04R 25/606 381/326 |

* cited by examiner

MAGNET PLACEMENT AND ANTENNA PLACEMENT OF AN IMPLANT

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. One example of a hearing prosthesis is a cochlear implant.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from hearing loss typically receive an acoustic hearing aid. Conventional hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve. Cases of conductive hearing loss typically are treated by means of bone conduction hearing aids. In contrast to conventional hearing aids, these devices use a mechanical actuator that is coupled to the skull bone to apply the amplified sound.

In contrast to hearing aids, which rely primarily on the principles of air conduction, certain types of hearing prostheses, commonly referred to as cochlear implants, convert a received sound into electrical stimulation. The electrical stimulation is applied to the cochlea, which results in the perception of the received sound.

Many devices, such as medical devices that interface with a recipient, have structural and/or functional features where there is utilitarian value in adjusting such features for an individual recipient. The process by which a device that interfaces with or otherwise is used by the recipient is tailored or customized or otherwise adjusted for the specific needs or specific wants or specific characteristics of the recipient is commonly referred to as fitting. One type of medical device where there is utilitarian value in fitting such to an individual recipient is the above-noted cochlear implant. That said, other types of medical devices, such as other types of hearing prostheses, exist where there is utilitarian value in fitting such to the recipient.

SUMMARY

In accordance with an exemplary embodiment, there is an implantable medical device, comprising a magnet; and an electromagnetic communication wire forming, with respect to two dimensions, an enclosed boundary, wherein the magnet is located outside of the enclosed boundary.

In accordance with another exemplary embodiment, there is an implantable medical device, comprising a ring-shaped magnet; and a functional component of the implantable medical device, wherein at least one of: the device is configured to enable the magnet to revolve; or the functional component is an electromagnetic communication coil and the magnet extends about the coil.

In accordance with another exemplary embodiment, there is a method, comprising holding an external component of a transcutaneous communication device including a first electromagnetic communication coil against skin of a recipient via a magnetic coupling extending from a first magnet outside the recipient to a second magnet implanted beneath the skin of the recipient, wherein with respect to a plane lying on a longitudinal axis extending between the first and second magnets, a 90 degree or more arcuate magnetic field path of the magnetic coupling extending in its entirety from a pole of the first magnet to a pole of the second magnet bypasses a second electromagnetic communication coil implanted in the recipient, wherein the first and second coils are substantially coaxial with one another.

BRIEF DESCRIPTION OF THE DRAWINGS

Embodiments are described below with reference to the attached drawings, in which.

DETAILED DESCRIPTION

Exemplary embodiments will be described in terms of a cochlear implant. That said, it is noted that the teachings detailed herein and/or variations thereof can be utilized with other types of hearing prostheses, such as by way of example, bone conduction devices, DACI/DACS/middle ear implants, etc. Still further, it is noted that the teachings detailed herein and/or variations thereof can be utilized with other types of prostheses, such as pacemakers, muscle stimulators, etc. In some instances, the teachings detailed herein and/or variations thereof are applicable to any type of implanted component (herein referred to as a medical device) having a magnet that is implantable in a recipient.

Figure 1A:
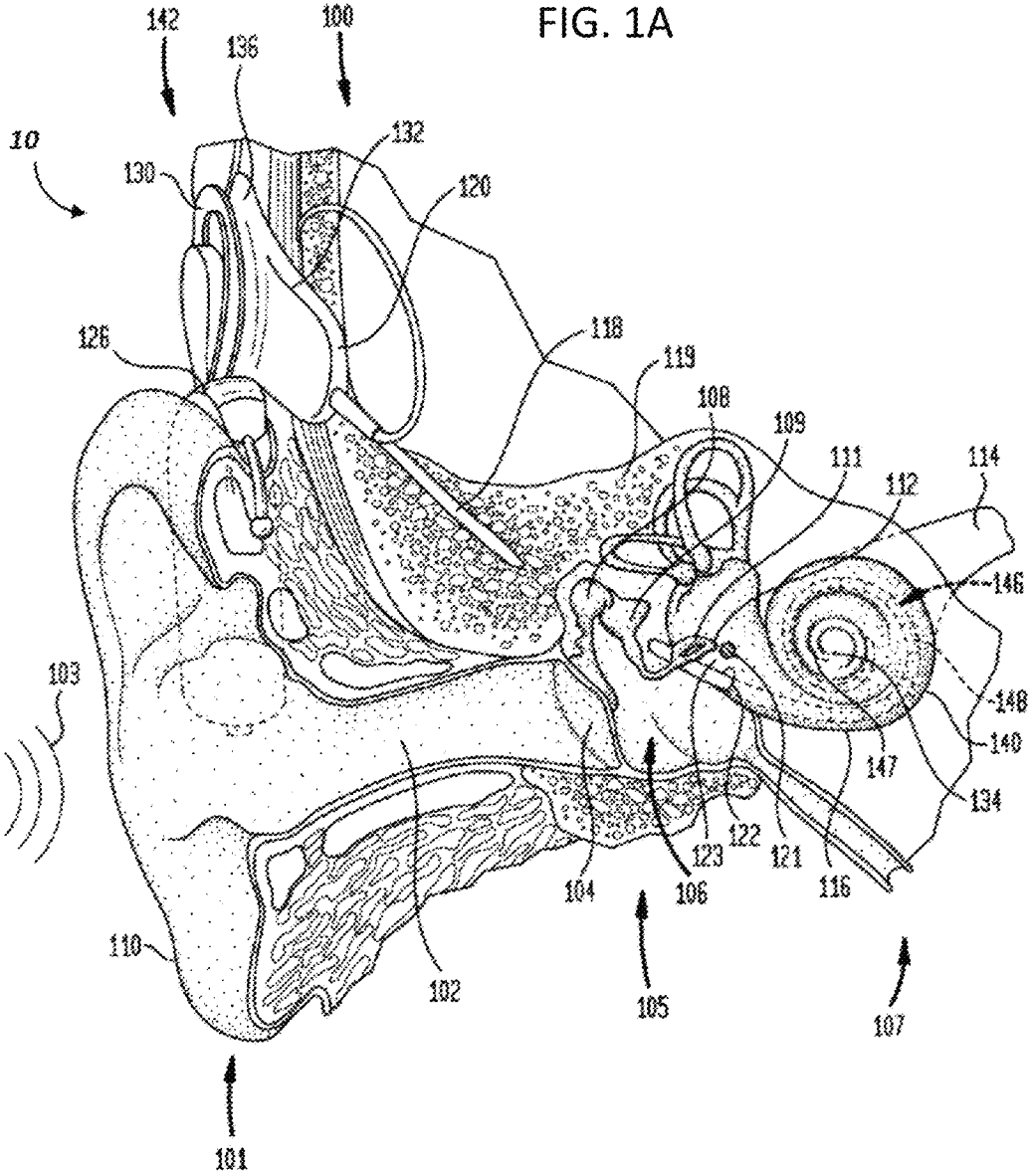
FIG. 1A is a perspective view of an exemplary hearing prosthesis in which at least some of the teachings detailed herein are applicable.

FIG. 1A is a perspective view of a cochlear implant, referred to as cochlear implant 100, implanted in a recipient, to which some embodiments detailed herein and/or variations thereof are applicable. The cochlear implant 100 is part of a system 10 that can include external components in some embodiments, as will be detailed below. It is noted that the teachings detailed herein are applicable, in at least some embodiments, to partially implantable and/or totally implantable cochlear implants (i.e., with regard to the latter, such as those having an implanted microphone). It is further noted that the teachings detailed herein are also applicable to other stimulating devices that utilize an electrical current beyond cochlear implants (e.g., auditory brain stimulators, pacemakers, etc.). Additionally, it is noted that the teachings detailed herein are also applicable to other types of hearing prostheses, such as by way of example only and not by way of limitation, bone conduction devices, direct acoustic cochlear stimulators, middle ear implants, etc. Indeed, it is noted that the teachings detailed herein are also applicable to so-called hybrid devices. In an exemplary embodiment, these hybrid devices apply both electrical stimulation and acoustic stimulation to the recipient. Any type of hearing prosthesis to which the teachings detailed herein and/or variations thereof that can have utility can be used in some embodiments of the teachings detailed herein.

In view of the above, it is to be understood that at least some embodiments detailed herein and/or variations thereof are directed towards a body-worn sensory supplement medical device (e.g., the hearing prosthesis of FIG. 1A, which supplements the hearing sense, even in instances where all natural hearing capabilities have been lost). It is noted that at least some exemplary embodiments of some sensory supplement medical devices are directed towards devices such as conventional hearing aids, which supplement the hearing sense in instances where some natural hearing capabilities have been retained, and visual prostheses (both those that are applicable to recipients having some natural vision capabilities remaining and to recipients having no natural vision capabilities remaining). Accordingly, the teachings detailed herein are applicable to any type of sensory supplement medical device to which the teachings detailed herein are enabled for use therein in a utilitarian manner. In this regard, the phrase sensory supplement medical device refers to any device that functions to provide sensation to a recipient irrespective of whether the applicable natural sense is only partially impaired or completely impaired.

The recipient has an outer ear 101, a middle ear 105, and an inner ear 107. Components of outer ear 101, middle ear 105, and inner ear 107 are described below, followed by a description of cochlear implant 100.

In a fully functional ear, outer ear 101 comprises an auricle 110 and an ear canal 102. An acoustic pressure or sound wave 103 is collected by auricle 110 and channeled into and through ear canal 102. Disposed across the distal end of ear channel 102 is a tympanic membrane 104 which vibrates in response to sound wave 103. This vibration is coupled to oval window or fenestra ovalis 112 through three bones of middle ear 105, collectively referred to as the ossicles 106 and comprising the malleus 108, the incus 109, and the stapes 111. Bones 108, 109, and 111 of middle ear 105 serve to filter and amplify sound wave 103, causing oval window 112 to articulate, or vibrate in response to vibration of tympanic membrane 104. This vibration sets up waves of fluid motion of the perilymph within cochlea 140. Such fluid motion, in turn, activates tiny hair cells (not shown) inside of cochlea 140. Activation of the hair cells causes appropriate nerve impulses to be generated and transferred through the spiral ganglion cells (not shown) and auditory nerve 114 to the brain (also not shown) where they are perceived as sound.

As shown, cochlear implant 100 comprises one or more components which are temporarily or permanently implanted in the recipient. Cochlear implant 100 is shown in FIG. 1A with an external device 142, that is part of system 10 (along with cochlear implant 100), which, as described below, is configured to provide power to the cochlear implant, and where the implanted cochlear implant includes a battery, that is recharged by the power provided from the external device 142.

In the illustrative arrangement of FIG. 1A, external device 142 can comprise a power source (not shown) disposed in a Behind-The-Ear (BTE) unit 126. External device 142 also includes components of a transcutaneous energy transfer link, referred to as an external energy transfer assembly. The transcutaneous energy transfer link is used to transfer power and/or data to cochlear implant 100. Various types of energy transfer, such as infrared (IR), electromagnetic, capacitive and inductive transfer, may be used to transfer the power and/or data from external device 142 to cochlear implant 100. In the illustrative embodiments of FIG. 1A, the external energy transfer assembly comprises an external coil 130 that forms part of an inductive radio frequency (RF) communication link. External coil 130 is typically a wire antenna coil comprised of multiple turns of electrically insulated single-strand or multi-strand platinum or gold wire. External device 142 also includes a magnet (not shown) positioned within the turns of wire of external coil 130. It should be appreciated that the external device shown in FIG. 1A is merely illustrative, and other external devices may be used with embodiments of the present invention.

Cochlear implant 100 comprises an internal energy transfer assembly 132 which can be positioned in a recess of the temporal bone adjacent auricle 110 of the recipient. As detailed below, internal energy transfer assembly 132 is a component of the transcutaneous energy transfer link and receives power and/or data from external device 142. In the illustrative embodiment, the energy transfer link comprises an inductive RF link, and internal energy transfer assembly 132 comprises a primary internal coil assembly 137. Internal coil assembly 137 typically includes a wire antenna coil comprised of multiple turns of electrically insulated single-strand or multi-strand platinum or gold wire, as will be described in greater detail below.

Cochlear implant 100 further comprises a main implantable component 120 and an elongate electrode assembly 118. Collectively, the coil assembly 137, the main implantable component 120, and the electrode assembly 118 correspond to the implantable component of the system 10.

In some embodiments, internal energy transfer assembly 132 and main implantable component 120 are hermetically sealed within a biocompatible housing. In some embodiments, main implantable component 120 includes an implantable microphone assembly (not shown) and a sound processing unit (not shown) to convert the sound signals received by the implantable microphone or via internal energy transfer assembly 132 to data signals. That said, in some alternative embodiments, the implantable microphone assembly can be located in a separate implantable component (e.g., that has its own housing assembly, etc.) that is in signal communication with the main implantable component 120 (e.g., via leads or the like between the separate implantable component and the main implantable component 120). In at least some embodiments, the teachings detailed herein and/or variations thereof can be utilized with any type of implantable microphone arrangement.

Main implantable component 120 further includes a stimulator unit (also not shown in FIG. 1A) which generates electrical stimulation signals based on the data signals. The electrical stimulation signals are delivered to the recipient via elongate electrode assembly 118.

Elongate electrode assembly 118 has a proximal end connected to main implantable component 120, and a distal end implanted in cochlea 140. Electrode assembly 118 extends from main implantable component 120 to cochlea 140 through mastoid bone 119. In some embodiments electrode assembly 118 may be implanted at least in basal region 116, and sometimes further. For example, electrode assembly 118 may extend towards apical end of cochlea 140, referred to as cochlea apex 134. In certain circumstances, electrode assembly 118 may be inserted into cochlea 140 via a cochleostomy 122. In other circumstances, a cochleostomy may be formed through round window 121, oval window 112, the promontory 123, or through an apical turn 147 of cochlea 140.

Electrode assembly 118 comprises a longitudinally aligned and distally extending array 146 of electrodes 148, disposed along a length thereof. As noted, a stimulator unit generates stimulation signals which are applied by electrodes 148 to cochlea 140, thereby stimulating auditory nerve 114.

Figure 1B:
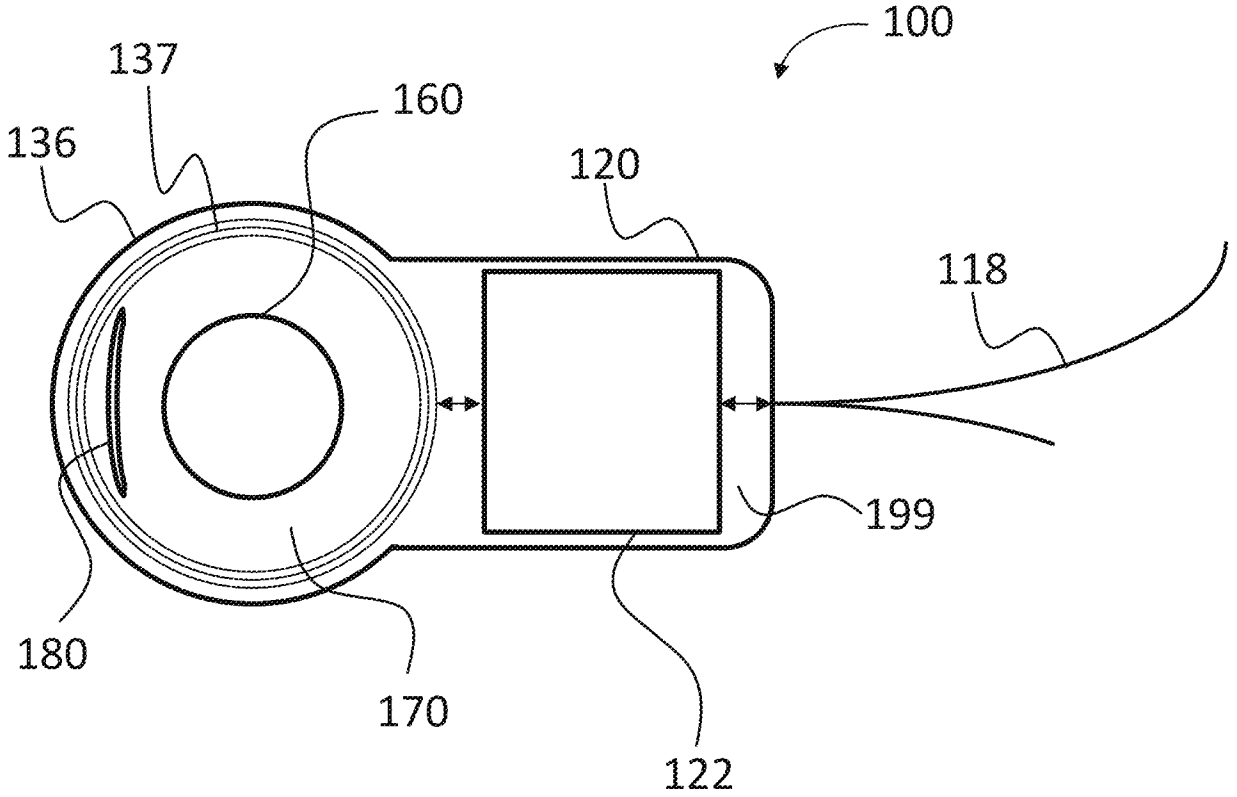
FIG. 1B is a top view of an exemplary hearing prosthesis in which at least some of the teachings detailed herein are applicable.

FIG. 1B depicts an exemplary high-level diagram of the implantable component 100 of the system 10, looking downward from outside the skull towards the skull. As can be seen, implantable component 100 includes a magnet 160 that is surrounded by a coil 137 that is in two-way communication (although in some instances, the communication is one-way) with a stimulator unit 122, which in turn is in communication with the electrode assembly 118.

Still with reference to FIG. 1B, it is noted that the stimulator unit 122, and the magnet apparatus 160 are located in a housing made of an elastomeric material 199, such as by way of example only and not by way of limitation, silicone. Hereinafter, the elastomeric material 199 of the housing will be often referred to as silicone. However, it is noted that any reference to silicone herein also corresponds to a reference to any other type of component that will enable the teachings detailed herein and/or variations thereof, such as, by way of example and not by way of limitation only, bio-compatible rubber, etc.

Figure 1C:
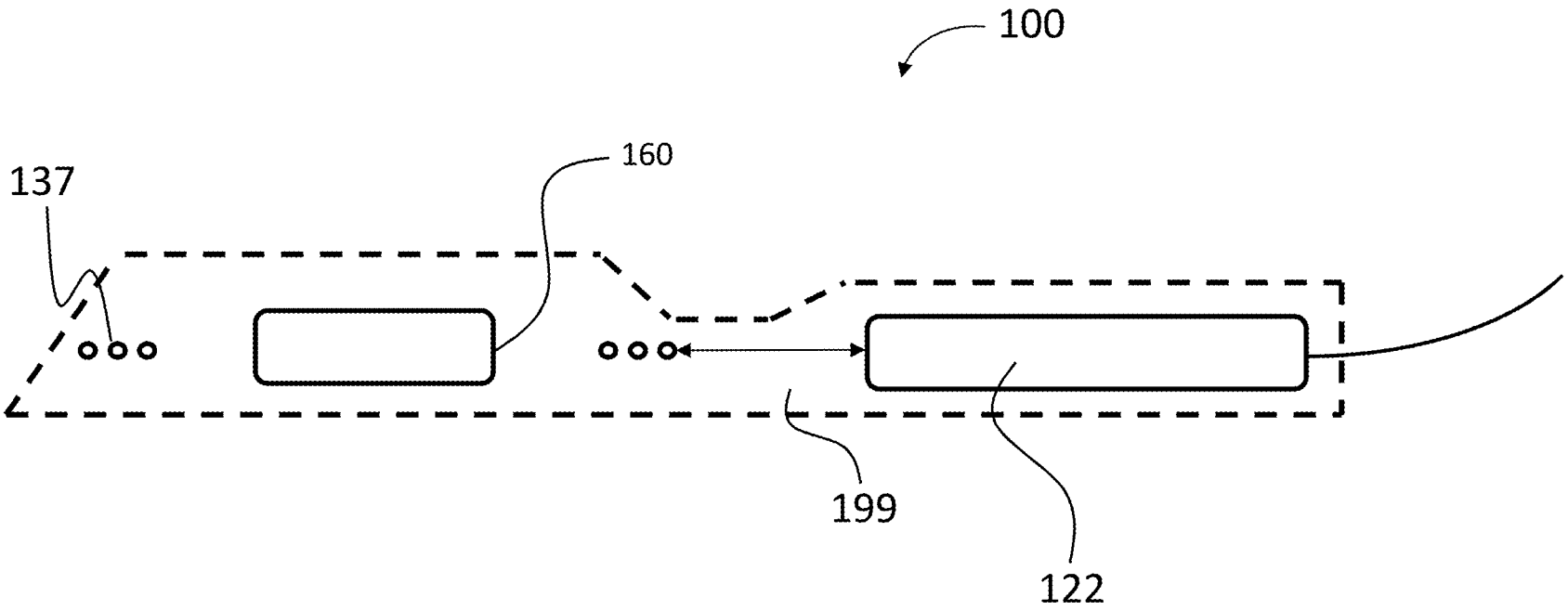
FIG. 1C is a side view of an exemplary hearing prosthesis in which at least some of the teachings detailed herein are applicable.

As can be seen in FIG. 1B, the housing made of elastomeric material 199 includes a slit 180 (not shown in FIG. 1C, as, in some instances, the slit is not utilized). In some variations, the slit 180 has utilitarian value in that it can enable insertion and/or removal of the magnet apparatus 160 from the housing made of elastomeric material 199.

It is noted that magnet apparatus 160 is presented in a conceptual manner. In this regard, it is noted that in at least some instances, the magnet apparatus 160 is an assembly that includes a magnet surrounded by a biocompatible coating. Still further by way of example, magnet apparatus 160 is an assembly where the magnet is located within a container having interior dimensions generally corresponding to the exterior dimensions of the magnet. This container can be hermetically sealed, thus isolating the magnet in the container from body fluids of the recipient that penetrate the housing (the same principle of operation occurs with respect to the aforementioned coated magnet). In an exemplary embodiment, this container permits the magnet to revolve or otherwise move relative to the container. Additional details of the container will be described below. In this regard, it is noted that while sometimes the term magnet is used as shorthand for the phrase magnet apparatus, and thus any disclosure herein with respect to a magnet also corresponds to a disclosure of a magnet apparatus according to the aforementioned embodiments and/or variations thereof and/or any other configuration that can have utilitarian value according to the teachings detailed herein.

Briefly, it is noted that there is utilitarian value with respect to enabling the magnet to revolve within the container or otherwise move. In this regard, in an exemplary embodiment, when the magnet is introduced to an external magnetic field, such as in an MRI machine, the magnet can revolve or otherwise move to substantially align with the external magnetic field. In an exemplary embodiment, this alignment can reduce or otherwise eliminate the torque on the magnet, thus reducing discomfort and/or reducing the likelihood that the implantable component will be moved during the MRI procedure (potentially requiring surgery to place the implantable component at its intended location) and thus reduce and/or eliminate the demagnetization of the magnet.

Element 136 can be considered a housing of the coil, in that it is part of the housing 199.

With reference now to FIG. 1C, it is noted that the outlines of the housing made from elastomeric material 199 are presented in dashed line format for ease of discussion. In an exemplary embodiment, silicone or some other elastomeric material fills the interior within the dashed line, other than the other components of the implantable device (e.g., plates, magnet, stimulator, etc.). That said, in an alternative embodiment, silicone or some other elastomeric material substantially fills the interior within the dashed lines other than the components of the implantable device (e.g., there can be pockets within the dashed line in which no components and no silicone are located).

It is noted that FIGS. 1B and 1C are conceptual FIGS. presented for purposes of discussion. Commercial embodiments corresponding to these FIGS. can be different from that depicted in the figures.

Figure 2A:
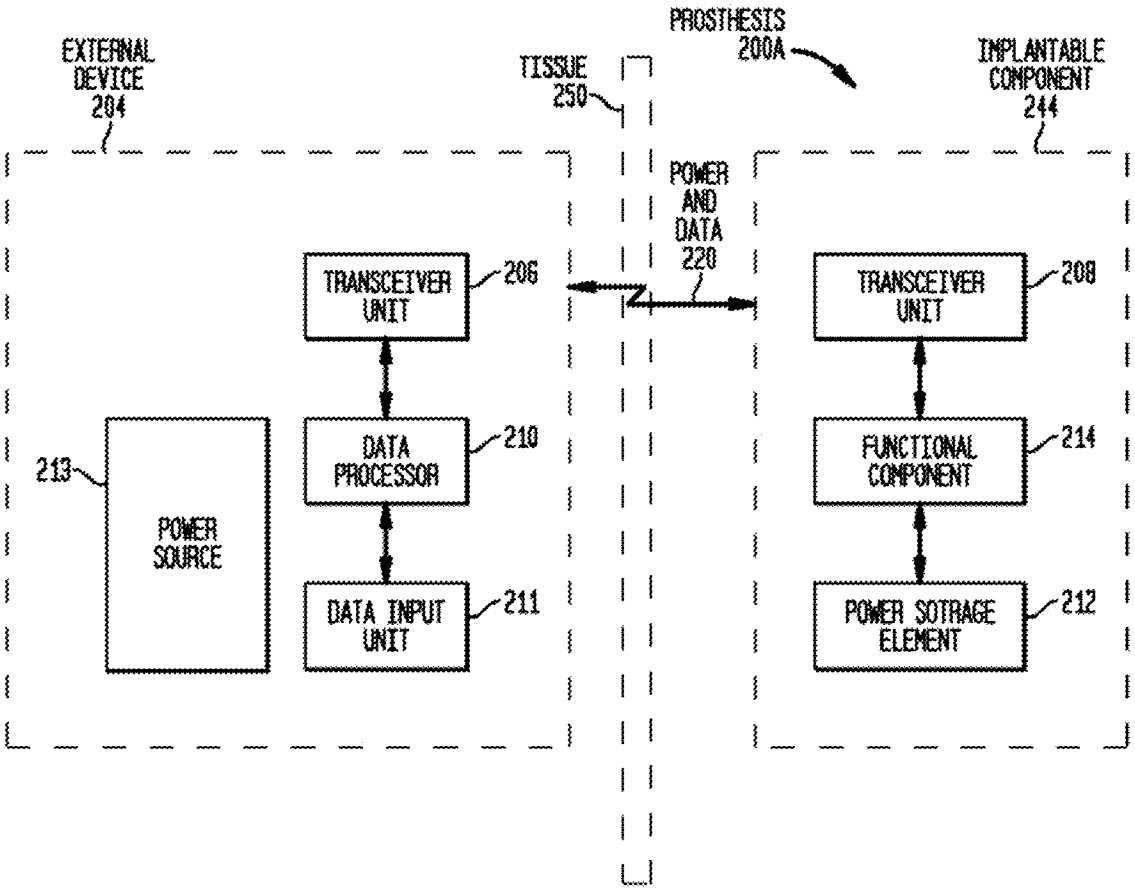
FIG. 2A is a functional block diagram of a prosthesis, in accordance with embodiments of the present invention.

FIG. 2A is a functional block diagram of a prosthesis 200A in accordance with embodiments of the present invention. Prosthesis 200A comprises an implantable component 244 configured to be implanted beneath a recipient's skin or other tissue 250 and an external device 204. For example, implantable component 244 may be implantable component 100 of FIG. 1A, and external device may be the external device 142 of FIG. 1A. Similar to the embodiments described above with reference to FIG. 1A, implantable component 244 comprises a transceiver unit 208 which receives data and power from external device 204. External device 204 transmits power and data 220 via transceiver unit 206 to transceiver unit 208 via a magnetic induction data link 220. As used herein, the term receiver refers to any device or component configured to receive power and/or data such as the receiving portion of a transceiver or a separate component for receiving. The details of transmission of power and data to transceiver unit 208 are provided below. With regard to transceivers, it is noted at this time that while embodiments of the present invention may utilize transceivers, separate receivers and/or transmitters may be utilized as appropriate. This will be apparent in view of the description below.

Implantable component 244 may comprises a power storage element 212 and a functional component 214. Power storage element 212 is configured to store power received by transceiver unit 208, and to distribute power, as needed, to the elements of implantable component 244. Power storage element 212 may comprise, for example, a rechargeable battery 212. An example of a functional component may be a stimulator unit 120 as shown in FIG. 1B.

In certain embodiments, implantable component 244 may comprise a single unit having all components of the implantable component 244 disposed in a common housing. In other embodiments, implantable component 244 comprises a combination of several separate units communicating via wire or wireless connections. For example, power storage element 212 may be a separate unit enclosed in a hermetically sealed housing. The implantable magnet apparatus and plates associated therewith may be attached to or otherwise be a part of any of these units, and more than one of these units can include the magnet apparatus and plates according to the teachings detailed herein and/or variations thereof.

In the embodiment depicted in FIG. 2A, external device 204 includes a data processor 210 that receives data from data input unit 211 and processes the received data. The processed data from data processor 210 is transmitted by transceiver unit 206 to transceiver unit 208. In an exemplary embodiment, data processor 210 may be a sound processor, such as the sound processor of FIG. 1A for the cochlear implant thereof, and data input unit 211 may be a microphone of the external device.

Figure 2B:
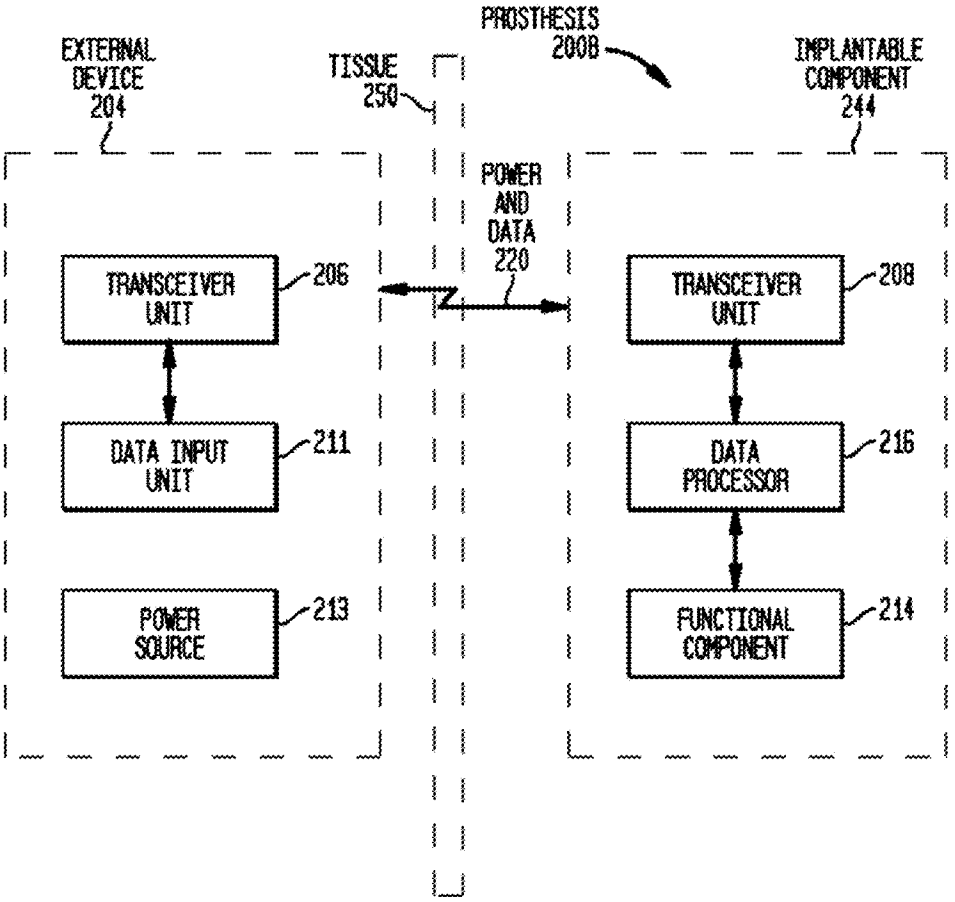
FIG. 2B is an alternate functional block diagram of a prosthesis, in accordance with embodiments of the present invention.

FIG. 2B presents an alternate embodiment of the prosthesis 200A of FIG. 2A, identified in FIG. 2B as prosthesis 200B. As may be seen from comparing FIG. 2A to FIG. 2B, the data processor can be located in the external device 204 or can be located in the implantable component 244. In some embodiments, both the external device 204 and the implantable component 244 can include a data processor.

As shown in FIGS. 2A and 2B, external device 204 can include a power source 213. Power from power source 213 can be transmitted by transceiver unit 206 to transceiver unit 208 to provide power to the implantable component 244, as will be described in more detail below.

While not shown in FIGS. 2A and 2B, external device 204 and/or implantable component 244 include respective inductive communication components. These inductive communication components can be connected to transceiver unit 206 and transceiver unit 208, permitting power and data 220 to be transferred between the two units via magnetic induction.

As used herein, an inductive communication component includes both standard induction coils and inductive communication components configured to vary their effective coil areas.

Figure 3A:
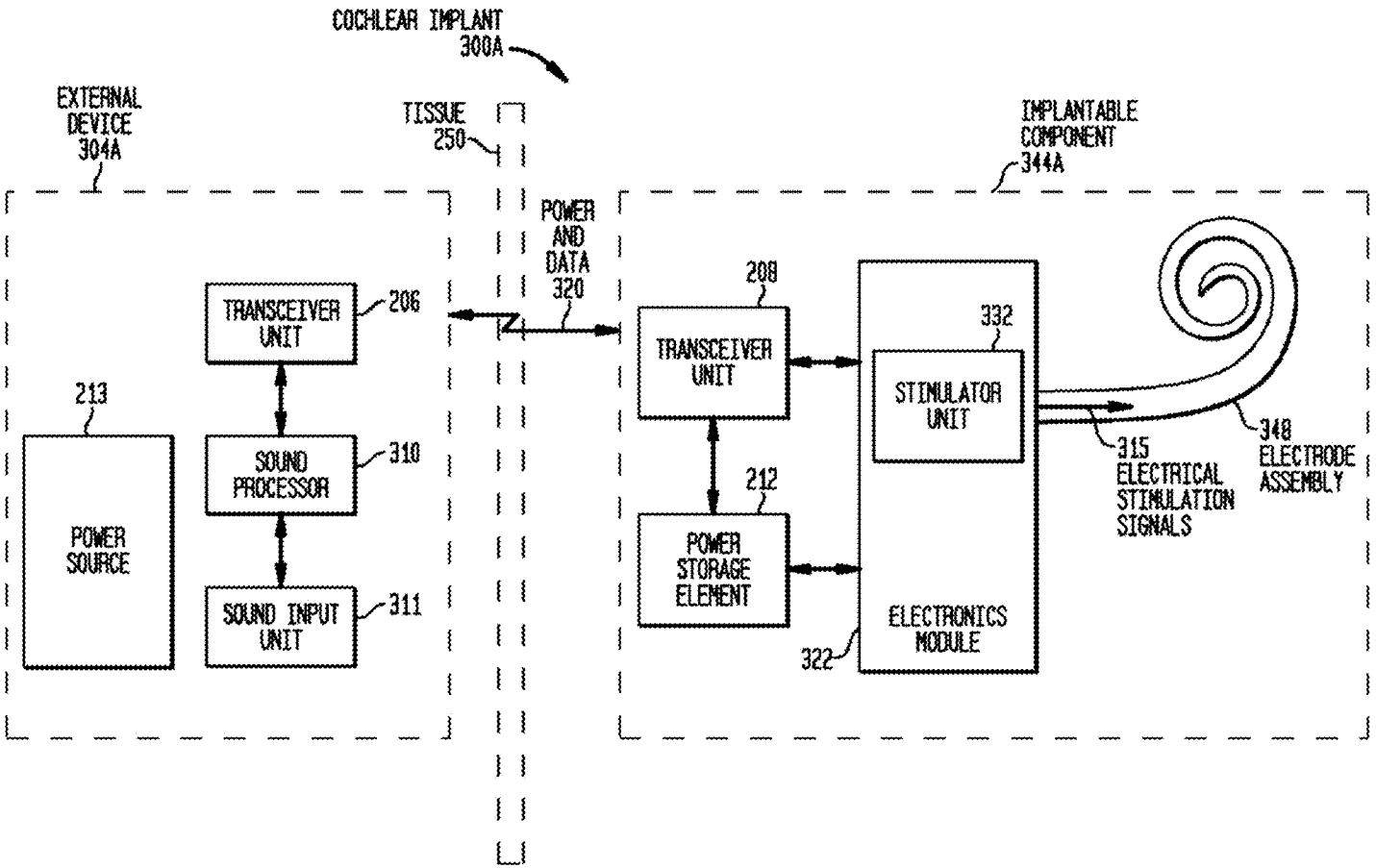
FIG. 3A is a functional block diagram of a cochlear implant, in accordance with embodiments of the present invention.

As noted above, prosthesis 200A of FIG. 2A may be a cochlear implant. In this regard, FIG. 3A provides additional details of an embodiment of FIG. 2A where prosthesis 200A is a cochlear implant. Specifically, FIG. 3A is a functional block diagram of a cochlear implant 300 in accordance with embodiments of the present invention.

It is noted that the components detailed in FIGS. 2A and 2B may be identical to the components detailed in FIG. 3A, and the components of 3A may be used in the embodiments depicted in FIGS. 2A and 2B.

Cochlear implant 300A comprises an implantable component 344A (e.g., implantable component 100 of FIG. 1) configured to be implanted beneath a recipient's skin or other tissue 250, and an external device 304A. External device 304A may be an external component such as external component 142 of FIG. 1.

Similar to the embodiments described above with reference to FIGS. 2A and 2B, implantable component 344A comprises a transceiver unit 208 (which may be the same transceiver unit used in FIGS. 2A and 2B) which receives data and power from external device 304A. External device 304A transmits data and/or power 320 to transceiver unit 208 via a magnetic induction data link. This can be done while charging module 202.

Implantable component 344A also comprises a power storage element 212, electronics module 322 (which may include components such as sound processor 126 and/or may include a stimulator unit 322 corresponding to stimulator unit 122 of FIG. 1B) and an electrode assembly 348 (which may include an array of electrode contacts 148 of FIG. 1A). Power storage element 212 is configured to store power received by transceiver unit 208, and to distribute power, as needed, to the elements of implantable component 344A.

As shown, electronics module 322 includes a stimulator unit 332. Electronics module 322 can also include one or more other functional components used to generate or control delivery of electrical stimulation signals 315 to the recipient. As described above with respect to FIG. 1A, electrode assembly 348 is inserted into the recipient's cochlea and is configured to deliver electrical stimulation signals 315 generated by stimulator unit 332 to the cochlea.

In the embodiment depicted in FIG. 3A, the external device 304A includes a sound processor 310 configured to convert sound signals received from sound input unit 311 (e.g., a microphone, an electrical input for an FM hearing system, etc.) into data signals. In an exemplary embodiment, the sound processor 310 corresponds to data processor 210 of FIG. 2A.

Figure 3B:
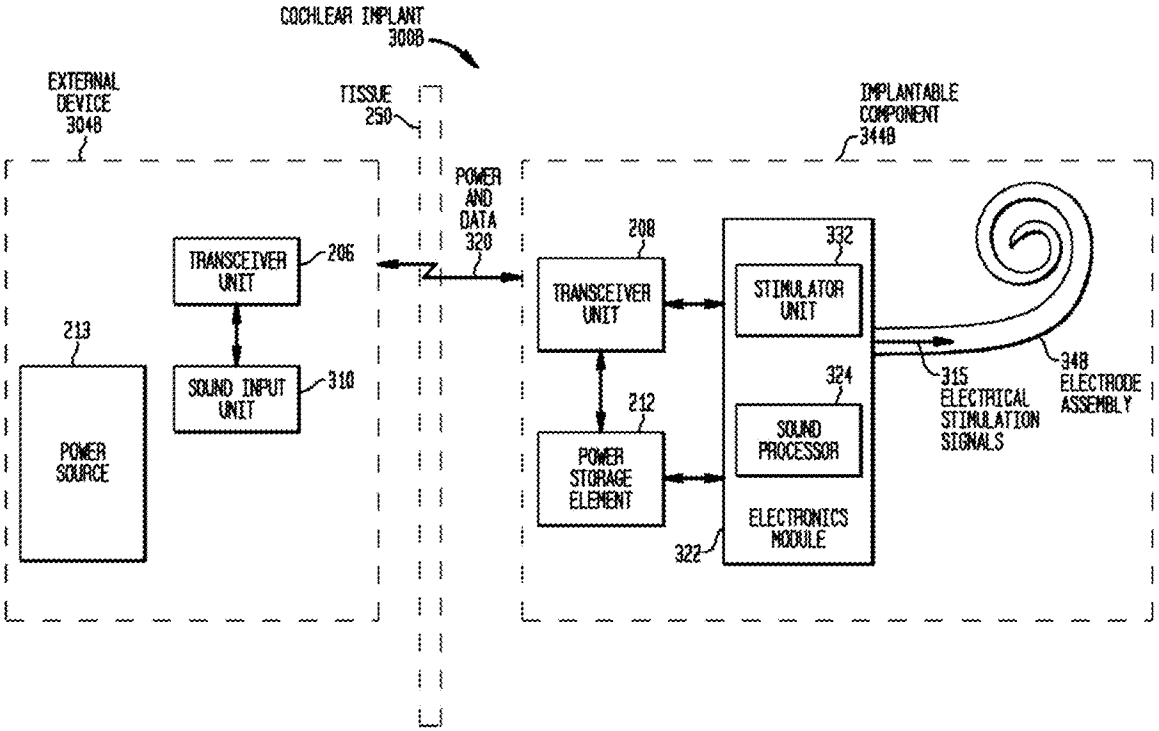
FIG. 3B is an alternate functional block diagram of a cochlear implant, accordance with embodiments of the present invention.

FIG. 3B presents an alternate embodiment of a cochlear implant 300B. The elements of cochlear implant 300B correspond to the elements of cochlear implant 300A, except that external device 304B does not include sound processor 310. Instead, the implantable component 344B includes a sound processor 324, which may correspond to sound processor 310 of FIG. 3A.

As will be described in more detail below, while not shown in the figures, external device 304A/304B and/or implantable component 344A/344B include respective inductive communication components.

FIGS. 3A and 3B illustrate that external device 304A/304B can include a power source 213, which may be the same as power source 213 depicted in FIG. 2A. Power from power source 213 can be transmitted by transceiver unit 306 to transceiver unit 308 to provide power to the implantable component 344A/344B, as will be detailed below. FIGS. 3A and 3B further detail that the implantable component 344A/344B can include a power storage element 212 that stores power received by the implantable component 344 from power source 213. Power storage element 212 may be the same as power storage element 212 of FIG. 2A.

Figure 3C:
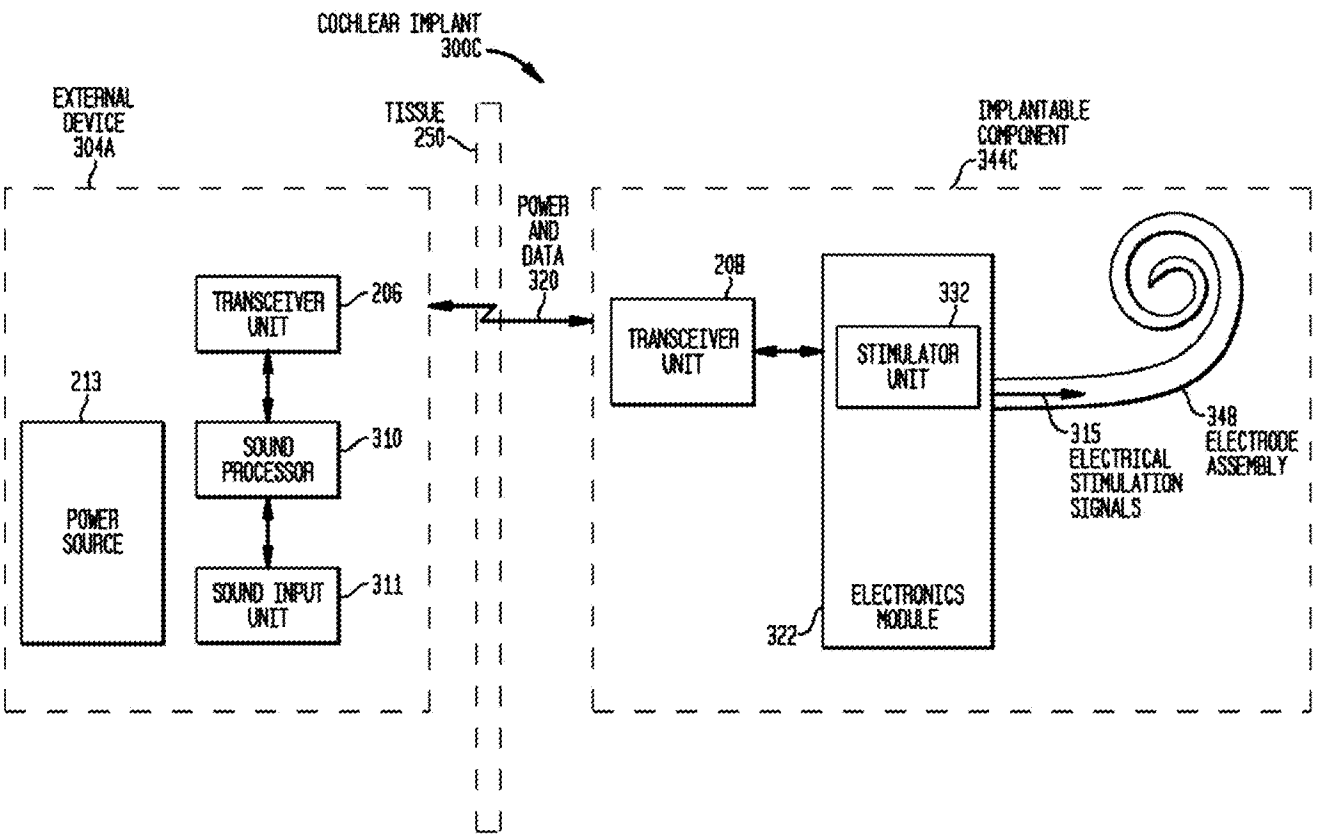
FIG. 3C is yet another alternate functional block diagram of a cochlear implant, in accordance with embodiments of the present invention.

In contrast to the embodiments of FIGS. 3A and 3B, as depicted in FIG. 3C, an embodiment of the present invention of a cochlear implant 300C includes an implantable component 344C that does not include a power storage element 212. In the embodiment of FIG. 3C, sufficient power is supplied by external device 304A/304B in real time to power implantable component 344C without storing power in a power storage element. In FIG. 3C, all of the elements are the same as FIG. 3A except for the absence of power storage element 212.

Some of the components of FIGS. 3A-3C will now be described in greater detail.

Figure 4A:
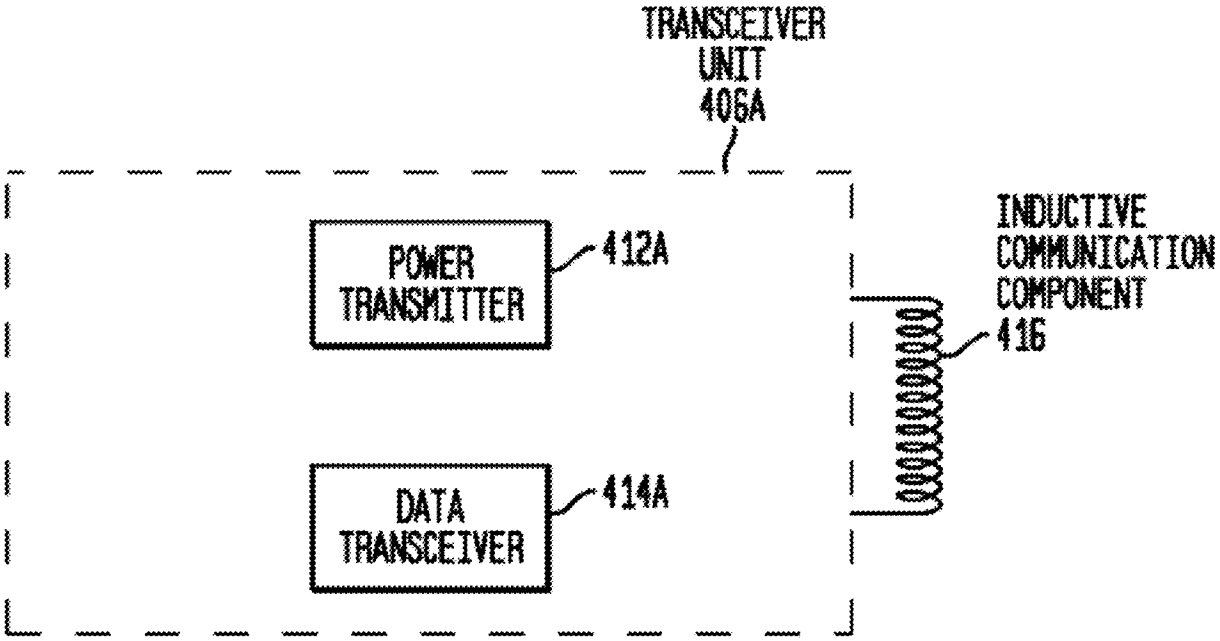
FIG. 4A is a simplified schematic diagram of a transceiver unit of an external device in accordance with embodiments of the present invention.

FIG. 4A is a simplified schematic diagram of a transceiver unit 406A in accordance with an embodiment of the present invention. An exemplary transceiver unit 406A may correspond to transceiver unit 206 of FIGS. 2A-3C. As shown, transceiver unit 406A includes a power transmitter 412 a, a data transceiver 414A and an inductive communication component 416.

In an exemplary embodiment, as will be described in more detail below, inductive communication component 416 comprises one or more wire antenna coils (depending on the embodiment) comprised of multiple turns of electrically insulated single-strand or multi-strand platinum or gold wire (thus corresponding to coil 137 of FIG. 1B). Power transmitter 412A comprises circuit components that inductively transmit power from a power source, such as power source 213, via an inductive communication component 416 to implantable component 344A/B/C (FIGS. 3A-3C). Data transceiver 414A comprises circuit components that cooperate to output data for transmission to implantable component 344A/B/C (FIGS. 3A-3C). Transceiver unit 406A can receive inductively transmitted data from one or more other components of cochlear implant 300A/B/C, such as telemetry or the like from implantable component 344A (FIG. 3A).

Transceiver unit 406A can be included in a device that includes any number of components which transmit data to implantable component 334A/B/C. For example, the transceiver unit 406A may be included in a behind-the-ear (BTE) device having one or more of a microphone or sound processor therein, an in-the-ear device, etc.

Figure 4B:
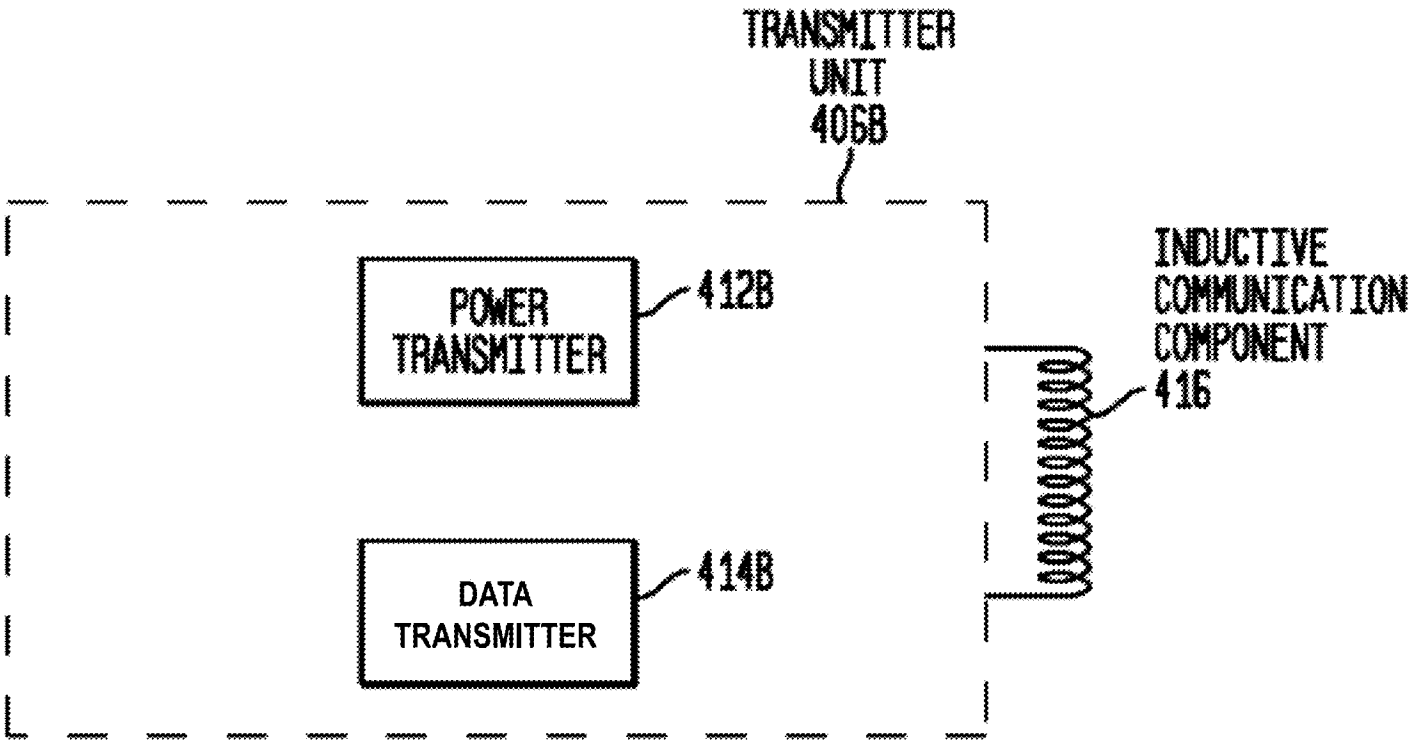
FIG. 4B is a simplified schematic diagram of a transmitter unit of an external device in accordance with embodiments of the present invention.

FIG. 4B depicts a transmitter unit 406B, which is identical to transceiver unit 406A, except that it includes a power transmitter 412B and a data transmitter 414B.

It is noted that for ease of description, power transmitter 412A and data transceiver 414A/data transmitter 414B are shown separate. However, it should be appreciated that in certain embodiments, at least some of the components of the two devices may be combined into a single device.

Figure 4C:
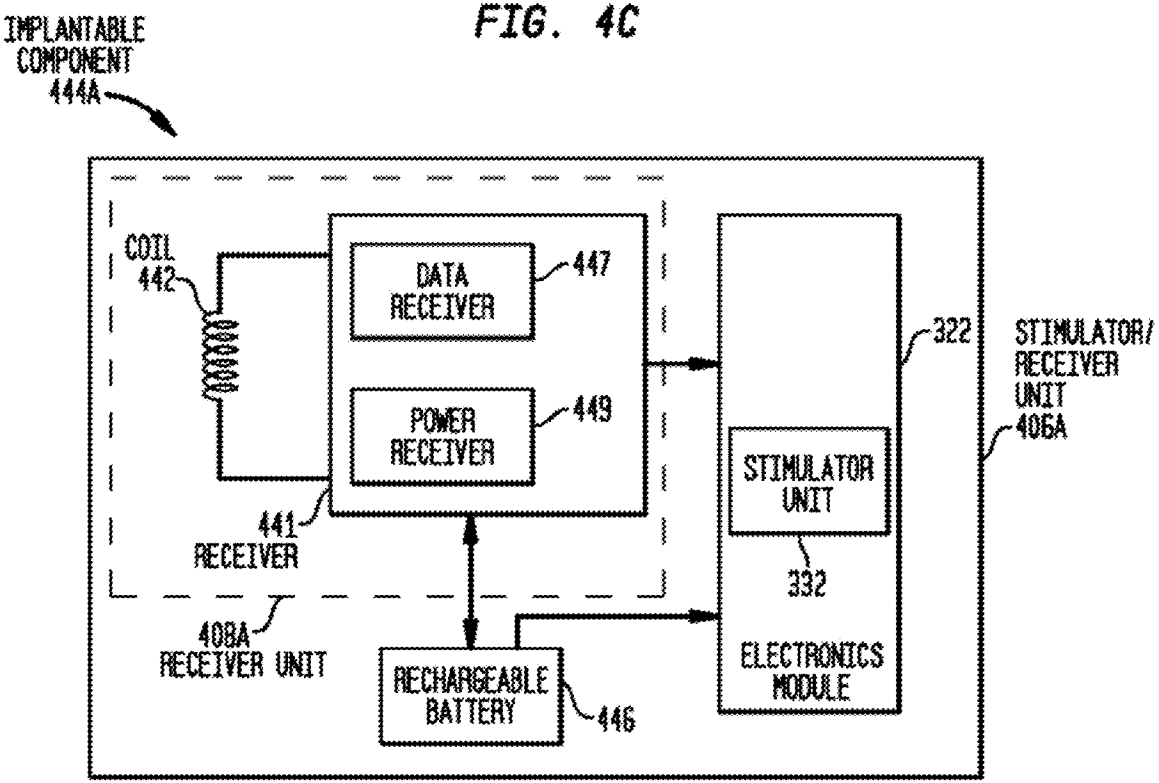
FIG. 4C is a simplified schematic diagram of a stimulator/receiver unit including a data receiver of an implantable device in accordance with embodiments of the present invention.

FIG. 4C is a simplified schematic diagram of one embodiment of an implantable component 444A that corresponds to implantable component 344A of FIG. 3A, except that transceiver unit 208 is a receiver unit. In this regard, implantable component 444A comprises a receiver unit 408A, a power storage element, shown as rechargeable battery 446, and electronics module 322, corresponding to electronics module 322 of FIG. 3A. Receiver unit 408A includes an inductance coil 442 connected to receiver 441. Receiver 441 comprises circuit components which receive, via an inductive communication component corresponding to an inductance coil 442, inductively transmitted data and power from other components of cochlear implant 300A/B/C, such as from external device 304A/B. The components for receiving data and power are shown in FIG. 4C as data receiver 447 and power receiver 449. For ease of description, data receiver 447 and power receiver 449 are shown separate. However, it should be appreciated that in certain embodiments, at least some of the components of these receivers may be combined into one component.

In the illustrative embodiments of the present invention, receiver unit 408A and transceiver unit 406A (or transmitter unit 406B) establish a transcutaneous communication link over which data and power is transferred from transceiver unit 406A (or transmitter unit 406B), to implantable component 444A. As shown, the transcutaneous communication link comprises a magnetic induction link formed by an inductance communication component system that includes inductive communication component 416 and coil 442.

The transcutaneous communication link established by receiver unit 408A and transceiver unit 406A (or whatever other viable component can so establish such a link), in an exemplary embodiment, may use time interleaving of power and data on a single radio frequency (RF) channel or band to transmit the power and data to implantable component 444A. A method of time interleaving power according to an exemplary embodiment uses successive time frames, each having a time length and each divided into two or more time slots. Within each frame, one or more time slots are allocated to power, while one or more time slots are allocated to data. In an exemplary embodiment, the data modulates the RF carrier or signal containing power. In an exemplary embodiment, transceiver unit 406A and transmitter unit 406B are configured to transmit data and power, respectively, to an implantable component, such as implantable component 344A, within their allocated time slots within each frame.

The power received by receiver unit 408A can be provided to rechargeable battery 446 for storage. The power received by receiver unit 408A can also be provided for distribution, as desired, to elements of implantable component 444A. As shown, electronics module 322 includes stimulator unit 332, which in an exemplary embodiment corresponds to stimulator unit 322 of FIGS. 3A-3C, and can also include one or more other functional components used to generate or control delivery of electrical stimulation signals to the recipient.

In an embodiment, implantable component 444A comprises a receiver unit 408A, rechargeable battery 446 and electronics module 322 integrated in a single implantable housing, referred to as stimulator/receiver unit 406A. It would be appreciated that in alternative embodiments, implantable component 344 may comprise a combination of several separate units communicating via wire or wireless connections.

Figure 4D:
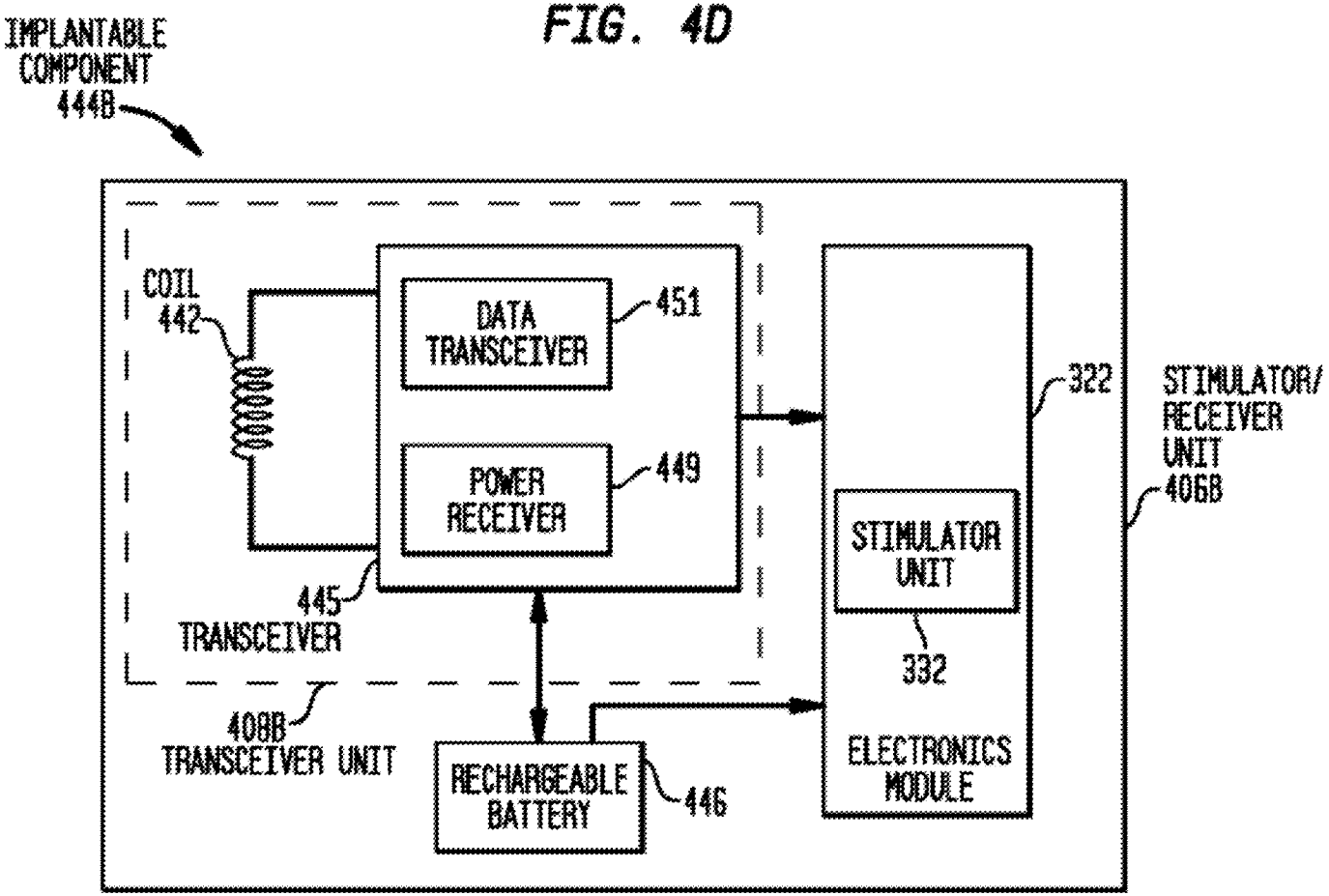
FIG. 4D is a simplified schematic diagram of a stimulator/receiver unit including a data transceiver of an implantable device in accordance with embodiments of the present invention.

FIG. 4D is a simplified schematic diagram of an alternate embodiment of an implantable component 444B. Implantable component 444B is identical to implantable component 444A of FIG. 4C, except that instead of receiver unit 408A, it includes transceiver unit 408B. Transceiver unit 408B includes transceiver 445 (as opposed to receiver 441 in FIG. 4C). Transceiver unit 445 includes data transceiver 451 (as opposed to data receiver 447 in FIG. 4C).

Figure 4E:
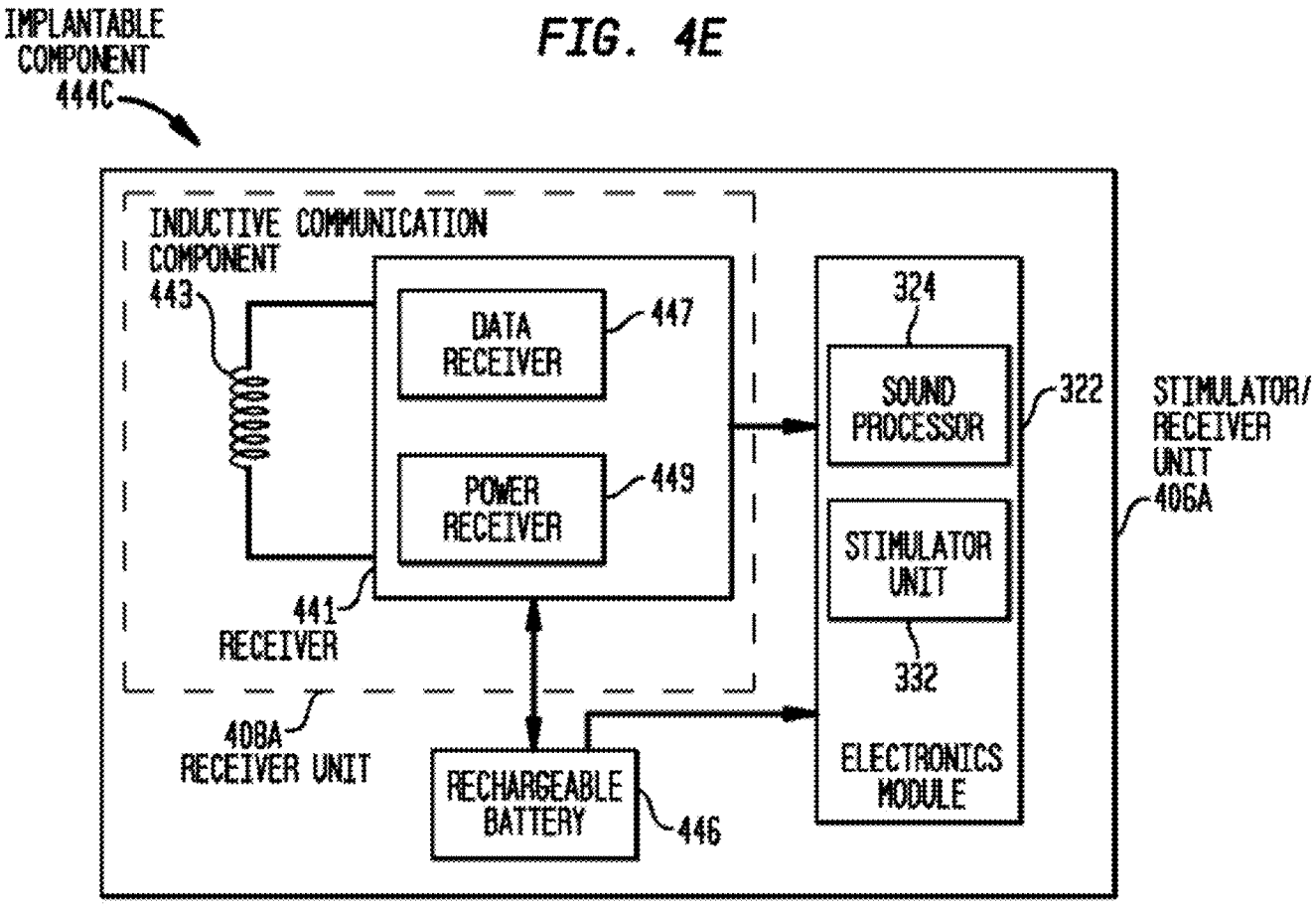
FIG. 4E is a simplified schematic diagram of a stimulator/receiver unit including a data receiver and a communication component configured to vary the effective coil area of an implantable device in accordance with embodiments of the present invention.
Figure 4F:
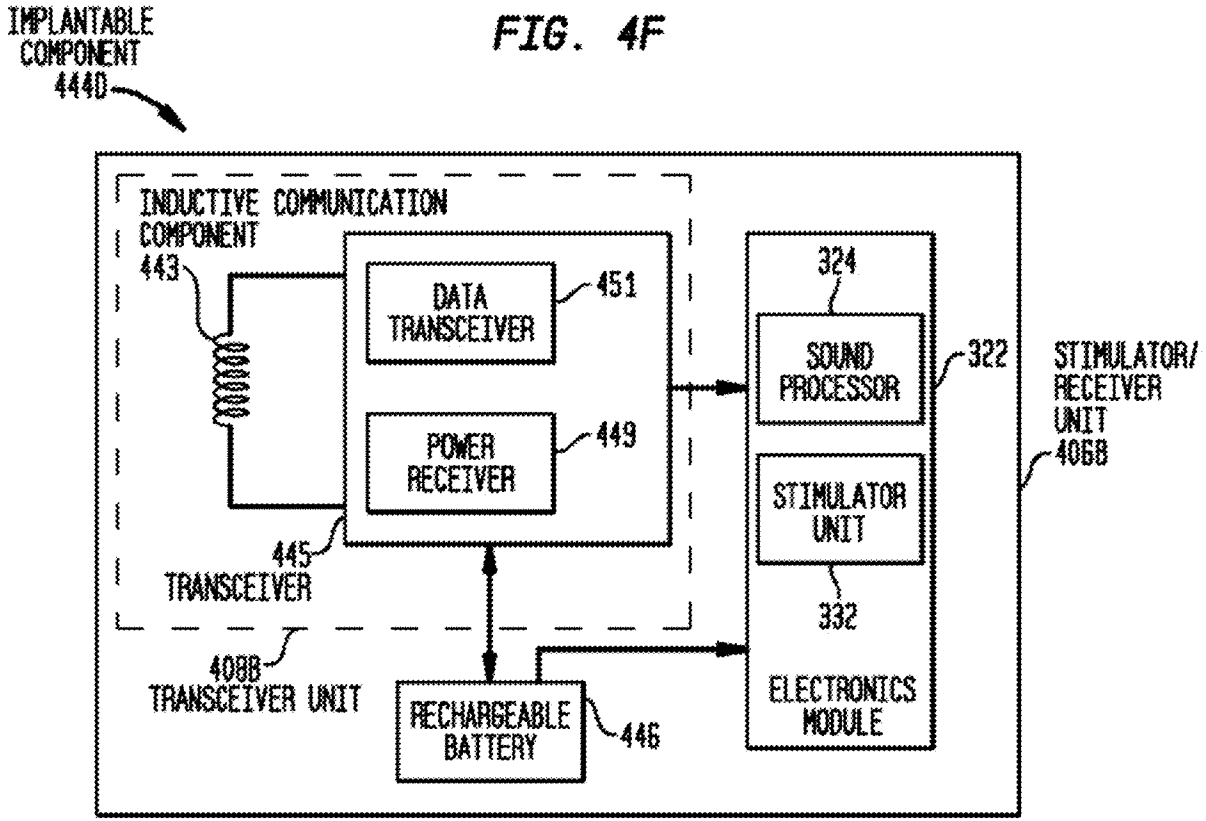
FIG. 4F is a simplified schematic diagram of a stimulator/receiver unit including a data transceiver and a communication component configured to vary the effective coil area of an implantable device in accordance with embodiments of the present invention.

FIGS. 4E and 4F depict alternate embodiments of the implantable components 444A and 444B depicted in FIGS. 4C and 4D, respectively. In FIGS. 4E and 4F, instead of coil 442, implantable components 444C and 444D (FIGS. 4E and 4F, respectively) include inductive communication component 443. Inductive communication component 443 is configured to vary the effective coil area of the component, and may be used in cochlear implants where the exterior device 304A/B does not include a communication component configured to vary the effective coil area (i.e., the exterior device utilizes a standard inductance coil). In other respects, the implantable components 444C and 444D are substantially the same as implantable components 444A and 444B. Note that in the embodiments depicted in FIGS. 4E and 4F, the implantable components 444C and 444D are depicted as including a sound processor 342. In other embodiments, the implantable components 444C and 444D may not include a sound processor 342.

Figure 5:
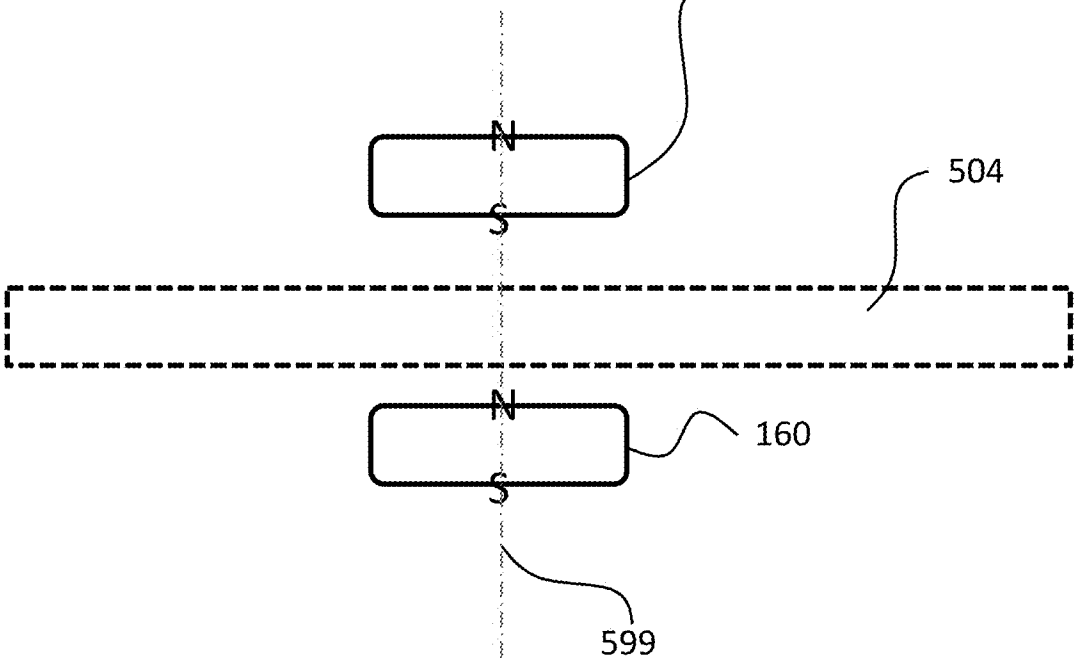
FIG. 5 is an exemplary conceptual schematic of a magnet system arrangement according to an exemplary embodiment.

FIG. 5 represents a high level conceptual exemplary magnetic coupling arrangement according to an exemplary embodiment. Specifically, FIG. 5 presents the magnet apparatus 160 of the implantable component 100 having a longitudinal axis 599 aligned with the magnet 560 of the external device 142, along with a functional representation of the tissue 504 of the recipient located between the two components. All other components of the external device and implantable component are not shown for purposes of clarity. As can be seen, the magnet apparatus 160 as a north-south polar axis aligned with the longitudinal axis 599, and magnet apparatus 560 also has a north-south polar axis aligned with the longitudinal axis of that magnet apparatus. In the exemplary embodiment, owing to the arrangements of the magnets, the resulting magnetic field aligns the magnets such that the longitudinal axes of the magnets are aligned. In an exemplary embodiment, because the various coils of the devices are aligned with the various longitudinal axes of the magnets, the alignment of the magnets aligns the coils.

Figure 6:
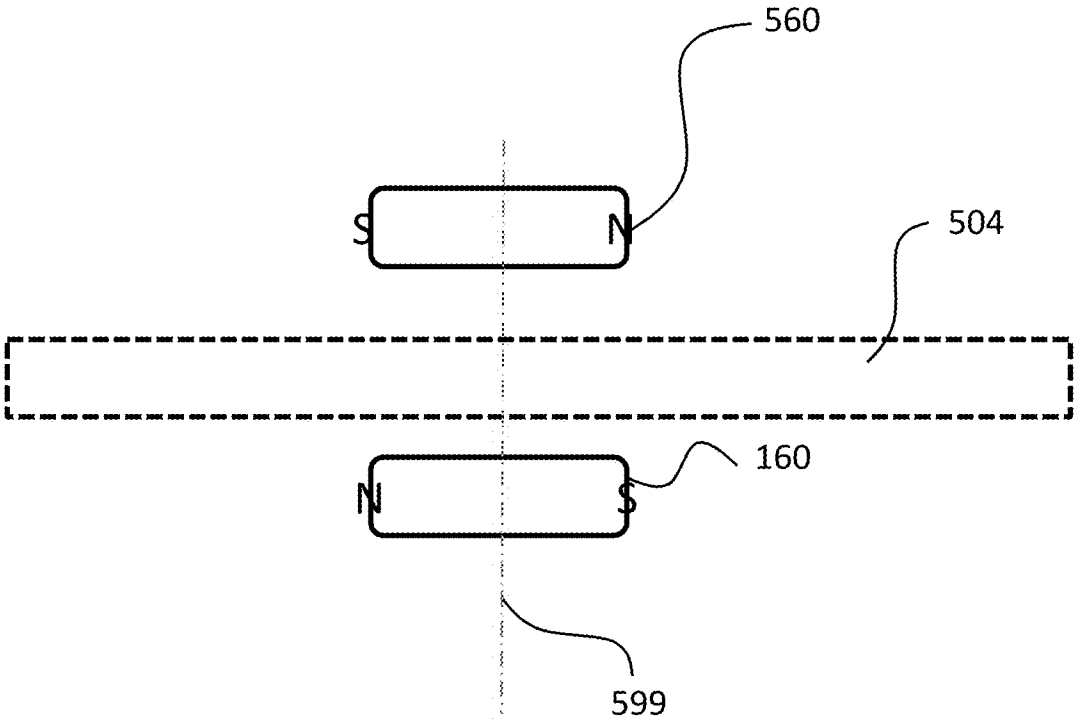
FIG. 6 is another exemplary conceptual schematic of a magnet system arrangement according to an exemplary embodiment.

FIG. 6 presents an alternative embodiment, where the magnet apparatus 160 of the implantable component 100 has a north-south axis aligned with the lateral axis of the magnet apparatus, as can be seen. In this exemplary embodiment, the magnet 560 also has a north-south axis also aligned with the lateral axis of that magnet. This arrangement is known as "in-plane" polarization.

As can be inferred from FIGS. 1B and 1C, the magnet apparatus of the implantable component 100 is a disk magnet apparatus/has the form of a short cylinder. The magnet of the external device 142 can also have such a form. That said, in an alternative embodiment, the magnets can have another configuration (e.g., a plate magnet, a bar magnet, etc.). Moreover, in an alternative embodiment, two or more magnets can be used in the implantable device and/or in the external device. The magnets could be located outboard of the coil. Any arrangement of magnet(s) of any configuration that can have utilitarian value according to the teachings detailed herein and/or variations thereof can be utilized in at least some embodiments.

Figure 7A:
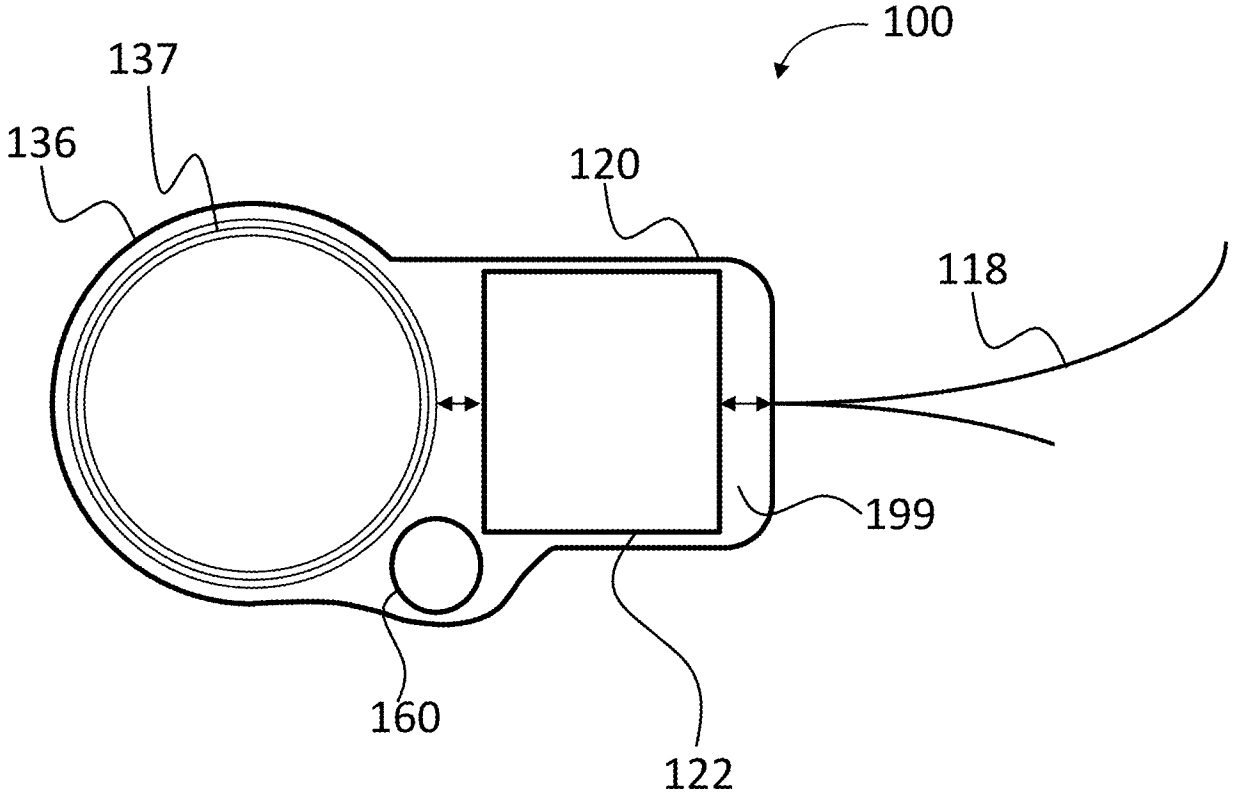
FIGS. 7A-11 represent exemplary conceptual schematics of various exemplary embodiments of some implantable components according to the teachings detailed herein.

FIG. 7A depicts an exemplary high-level diagram of the implantable component 100 of the system 10, looking downward from outside the skull towards the skull. As can be seen, implantable component 100 includes a magnet apparatus 160, but in contrast to the arrangement of FIG. 1B, the magnet 160 is not surrounded by the coil 137 (the coil is in two-way communication (although in other embodiments, the communication is one-way) with a stimulator unit 122, which in turn is in communication with the electrode assembly 118). As can be seen, the housing 199 extends outward on one side of the implantable component 100 to surround and otherwise envelop the magnet apparatus 160.

Still with reference to FIG. 7A, it is noted that the magnet apparatus 160 is located in a housing made of an elastomeric material 199, such as by way of example only and not by way of limitation, silicone. Hereinafter, the elastomeric material 199 of the housing will be often referred to as silicone. However, it is noted that any reference to silicone herein also corresponds to a reference to any other type of component that will enable the teachings detailed herein and/or variations thereof, such as, by way of example and not by way of limitation only, bio-compatible rubber, etc.

Not depicted in FIG. 7A, the housing made of elastomeric material 199 can include a slit. In an exemplary embodiment, the slit has utilitarian value in that it can enable insertion and/or removal of the magnet 160 from the housing made of elastomeric material 199. In an exemplary embodiment, tweezers or the like can be inserted into the slit to reach the magnet for withdrawal without removing the other portions of the implantable component 100 from the recipient after implantation. Some additional details of the exemplary slits that can be utilized to enable removal and reimplantation of the magnet 160 will be described in greater detail below. It is further noted that in some alternate embodiments, instead of the slit, an indicia or the like is provided on the housing indicating to the surgeon where the silicone should be cut to reach the magnet so that the magnet can be explanted. That is, instead of the pre-existing slit(s), the surgeon can effectively create the slit in the event that the magnet has to be removed.

Figure 7B:
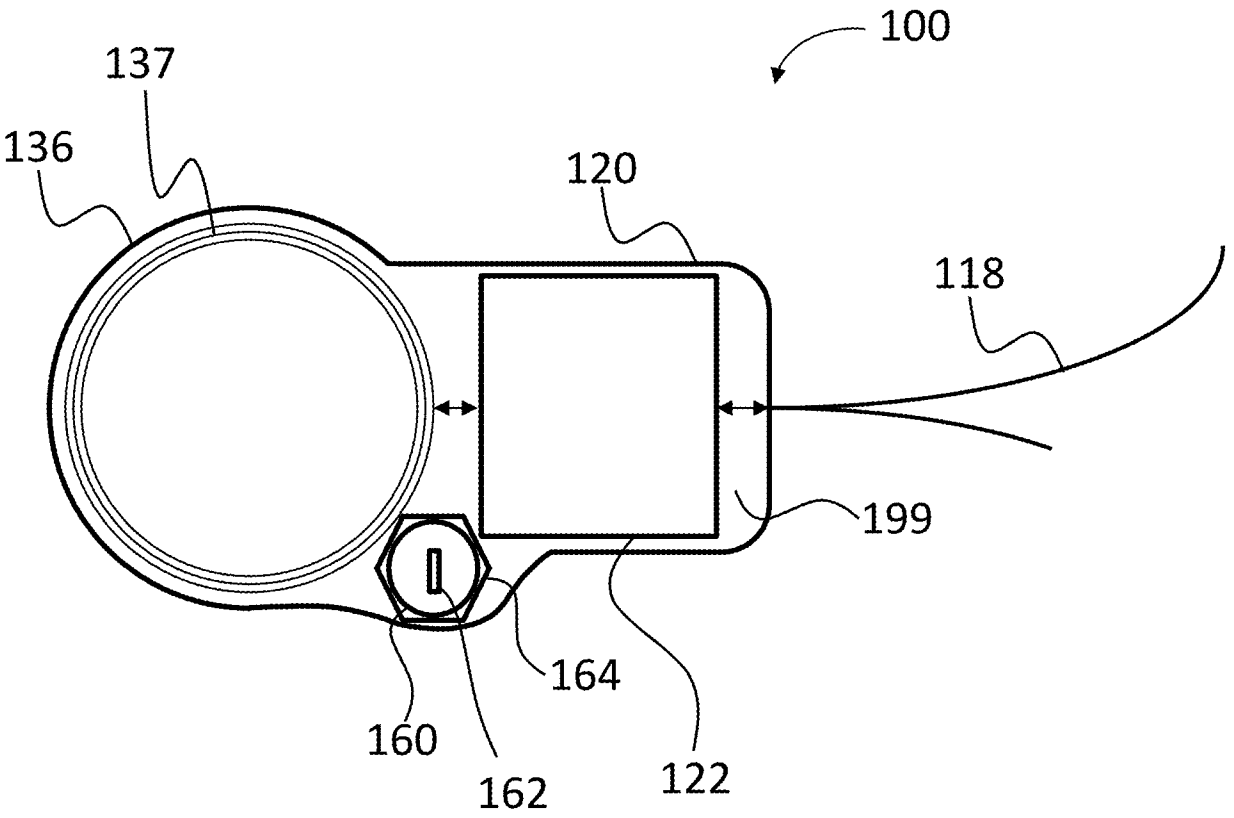

FIG. 7B depicts an alternate embodiment, where the magnet apparatus 160 is located in a chassis 164 that is embedded in the silicone housing 199. In this exemplary embodiment, the magnet apparatus 160 is threaded about the outer surface thereof with mail threads that interface with female threads of the chassis 164. In an exemplary embodiment, the magnet apparatus 160 is removable from the implantable component 100 by unscrewing the magnet apparatus 160 from the chassis 164. In an exemplary embodiment, torque can be applied via the recessed 162 utilizing a flat head screwdriver or the like. A Phillips wrench can be utilized with embodiments that utilize a hexagon recess. Any arrangement that can enable the magnet apparatus 160 to be removed and or reattached to the implantable component 100 without removing the implantable component from the recipient can be utilized in at least some exemplary embodiments.

In some exemplary embodiments, the housing completely envelops the chassis 164, and thus the magnet apparatus 160. In some embodiments, the housing envelops only the bottom (the opposite side from that shown in FIG. 7B—the side that faces the skull) and sides, and, in some instances, only a portion of the top of the chassis 164, thus providing an opening for the magnet apparatus to be removed from the housing 199. In some embodiments, the housing 199 completely envelops the chassis 164, and a slit is present, while in other embodiments, a surgeon must create a slit using a scalpel or the like to remove the magnet apparatus 160 from the chassis 164.

It is noted that magnet apparatus 160 is presented in a conceptual manner. In this regard, it is noted that in at least some embodiments, the magnet apparatus 160 is an assembly that includes a magnet surrounded by a biocompatible coating. Still further, in an exemplary embodiment, magnet apparatus 160 is an assembly where the magnet is located within a container having interior dimensions generally corresponding to the exterior dimensions of the magnet. This container can be hermetically sealed, thus isolating the magnet in the container from body fluids of the recipient that penetrate the housing (the same principle of operation occurs with respect to the aforementioned coated magnet). In an exemplary embodiment, this container permits the magnet to revolve or otherwise move relative to the container. Additional details of the container will be described below. In this regard, it is noted that while sometimes the term magnet is used as shorthand for the phrase magnet apparatus, and thus any disclosure herein with respect to a magnet also corresponds to a disclosure of a magnet apparatus according to the aforementioned embodiments and/or variations thereof, and/or any other configuration that can have utilitarian value according to the teachings detailed herein.

Thus, in an exemplary embodiment, there is an implantable medical device, such as the cochlear implant implantable component 100 detailed above, comprising a magnet, such as the magnet of magnet apparatus 160, and an electromagnetic communication wire, such as the inductance coil 137, forming, with respect to two dimensions (e.g., the dimensions of the plane on which FIGS. 7A and 7B are present), an enclosed boundary (i.e., the boundary inside any of the loops of the coil 137). In this exemplary embodiment, the magnet is located outside of the enclosed boundary.

Figure 8:
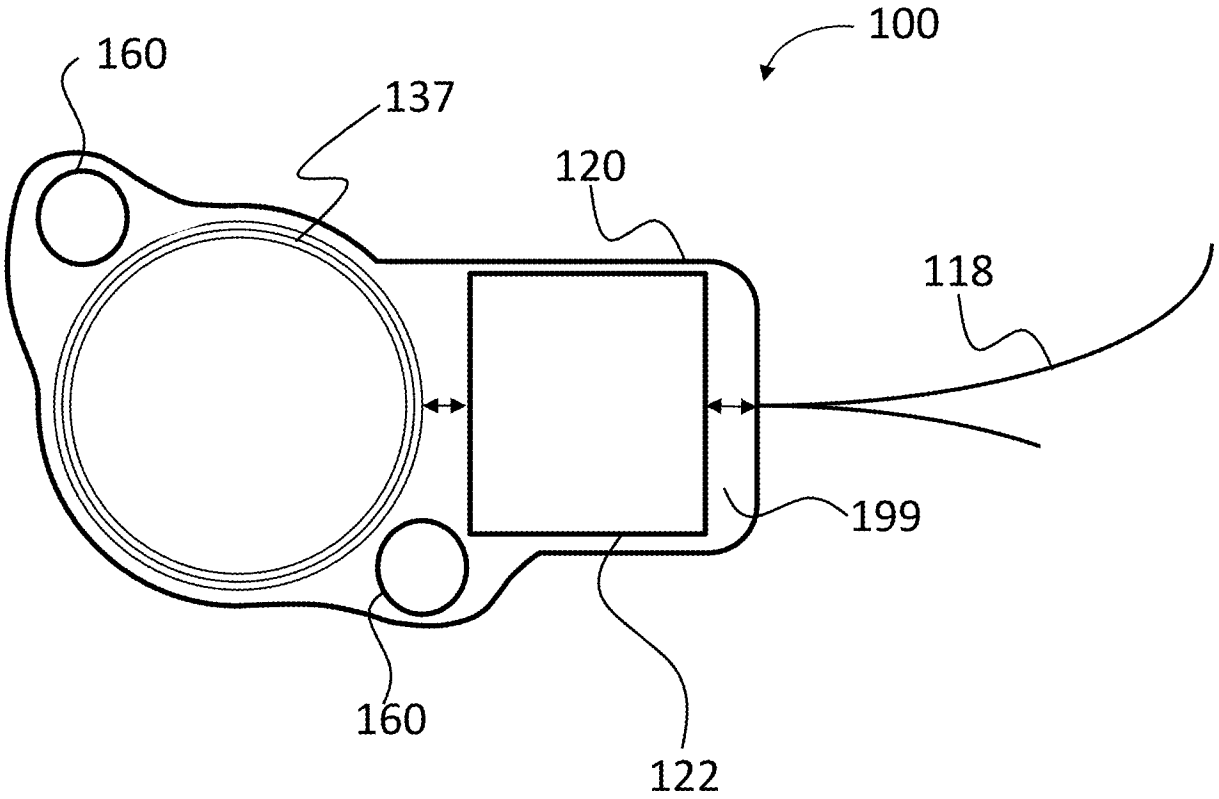

FIG. 8 depicts another exemplary embodiment which includes two magnet apparatuses 160, each of the magnet apparatuses located on an opposite side of the coil 137 in a symmetrical manner, although in other embodiments, the magnets can be located relative to the coil 137 in a non-symmetrical manner. As is the case with the embodiments of FIGS. 7A and 7B, the housing 199 is extended at the locations of the magnet apparatuses 160. In this regard, the features of the housing detailed above with regard to the single magnet apparatus 160 a FIGS. 7A and 7B are also applicable to the embodiment of FIG. 8.

Accordingly, in an exemplary embodiment, there is an implantable medical device, such as that of FIG. 8, wherein there is a first magnet and a second magnet, where the first and second magnets are located outside of the enclosed boundary established by the inductance coil 137.

Figure 9:
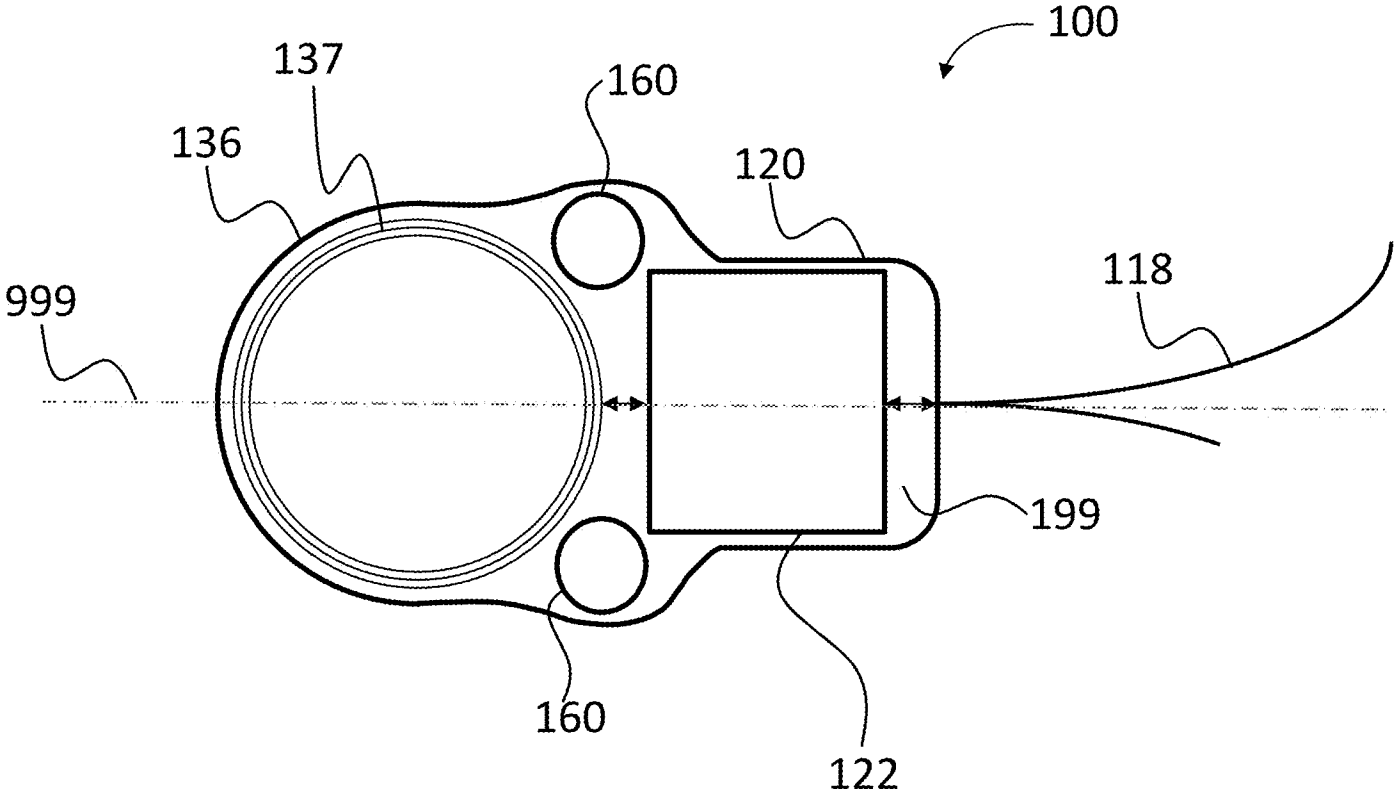
Figure 10A:
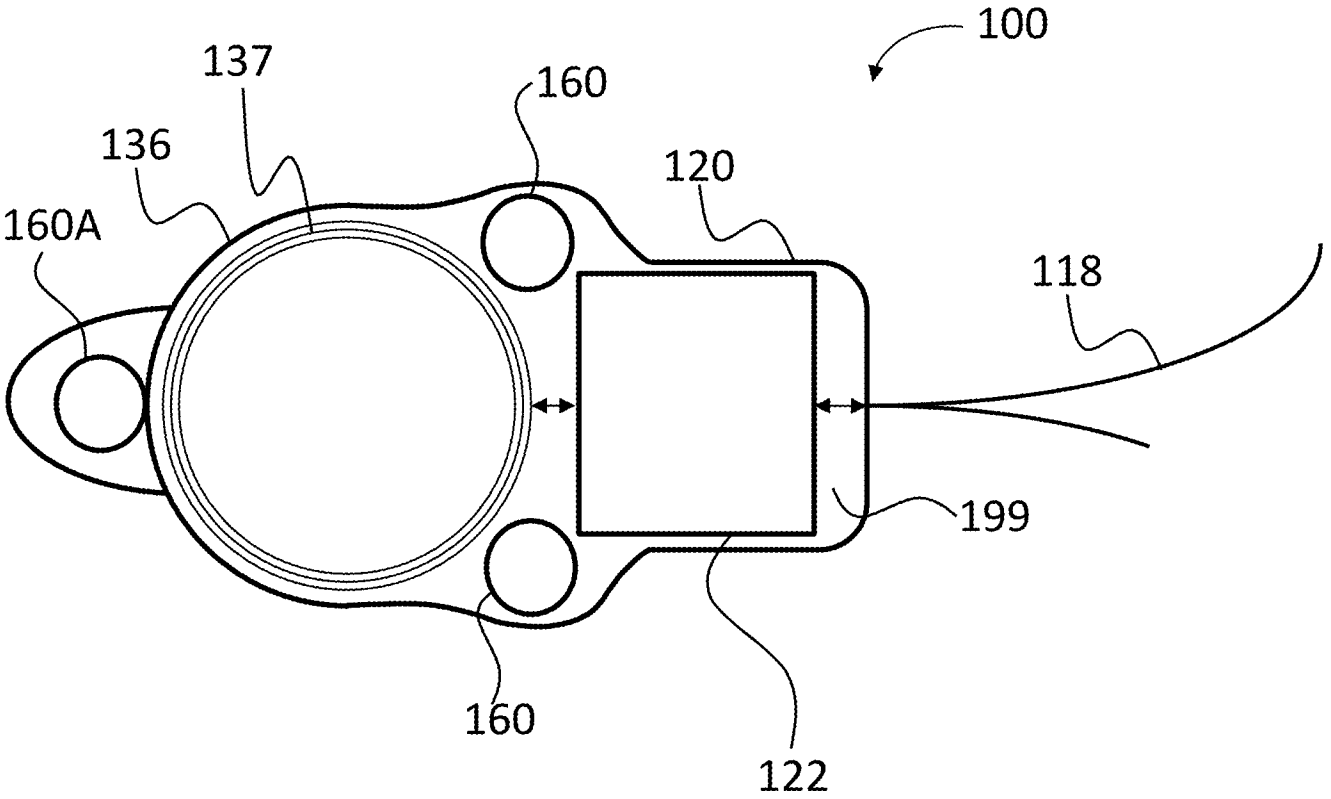

FIG. 9 depicts an alternate embodiment that utilizes a plurality of magnet apparatuses 160, wherein the magnet apparatus 160 is located in a symmetrical manner about the longitudinal axis 999 of the implantable component 100. FIG. 10 depicts an exemplary embodiment that utilizes three magnet apparatuses where, collectively, the magnet apparatuses 160 are symmetrically arrayed about the coil 137. Here, the magnet apparatus 160A is located in a sub housing that is separate from the housing 199 but attached thereto. That said, in an alternate embodiment, magnet apparatus 160A could be located in an extension of the housing 199 in a manner analogous to the magnets 160. Corollary to this is that in some exemplary embodiments, the magnets 160 could be located in a sub housing that is attached to the housing 199. Any arrangement that can enable the teachings detailed herein can be utilized in at least some exemplary embodiments.

Figure 10B:
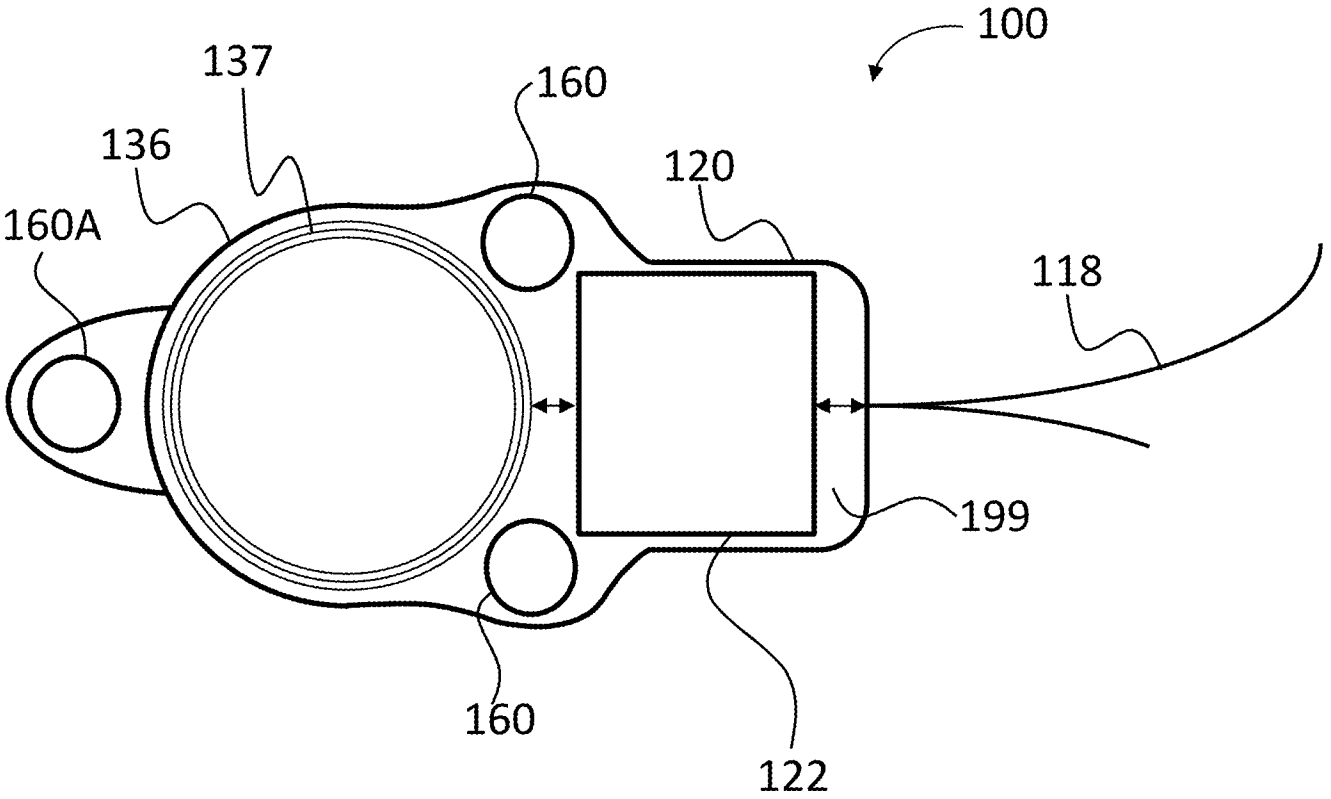

Thus, in view of the above, in some exemplary embodiments, there is an implantable component 100, that includes a first magnet (one of magnets 160) and a plurality of second magnets (the other of magnet 160 and also magnet 160A. As with the first magnet, the plurality of second magnets are located outside the enclosed boundary established by coil 137. In an exemplary embodiment, in combination, the first magnet in the plurality of second magnets are arrayed about the coil in a symmetric manner. That said, in an exemplary embodiment, the magnets can be arrayed about the coil and a substantially symmetric manner (which includes a symmetric manner). An exemplary embodiment of a substantially symmetric manner as seen in FIG. 10B, where magnet 160A is slightly further away from coil 137 then magnets 160.

Figure 11:
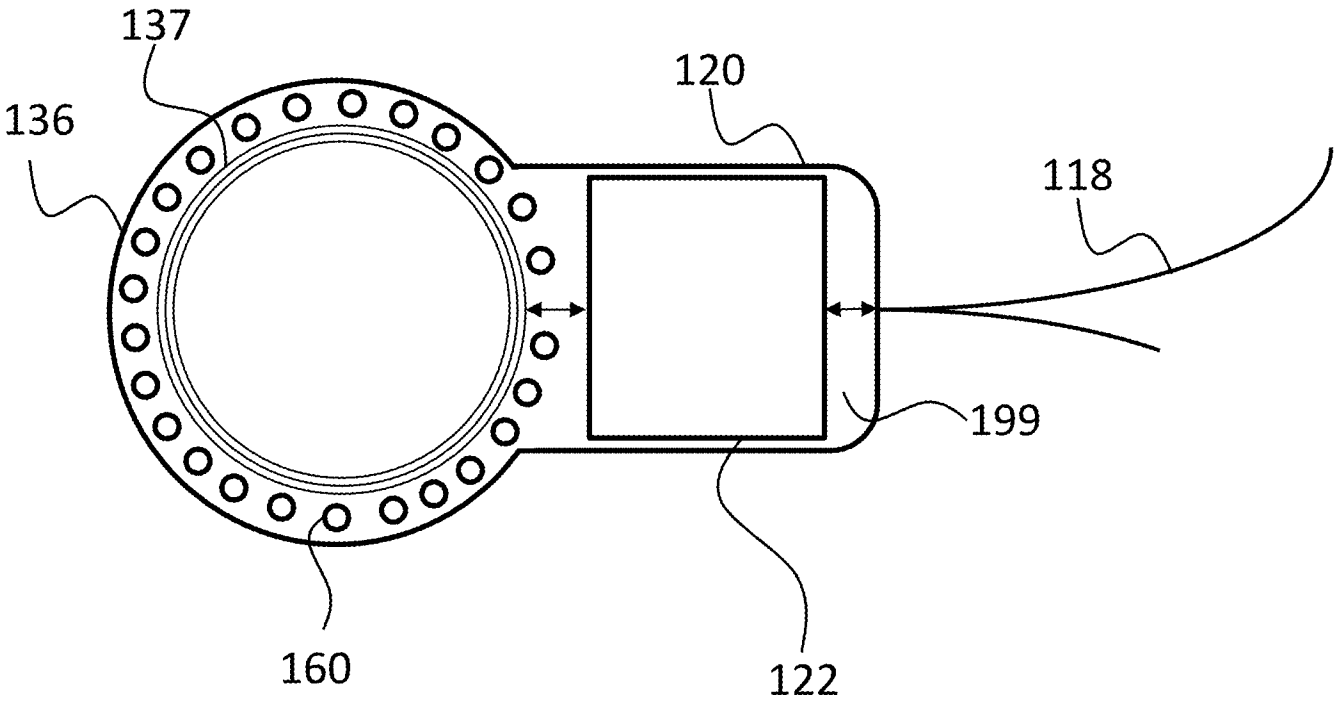

FIG. 11 depicts an alternate embodiment, where 25 magnets 160 are arrayed about the coil 137 in a substantially symmetrical manner (in some embodiments, a symmetrical manner). This embodiment also indicates that the magnet apparatus is 160 can be smaller in size and/or strength in embodiments that utilize more magnets. In this regard, it is the total magnetic attractive force between the external component and implantable component that holds the external component to the skin of the recipient. Thus, utilizing multiple magnets in some embodiments entails distributing this total force over a number of magnets. In some embodiments, this distribution of force is distributed evenly, while in other embodiments, the distribution of force is not distributed evenly.

Figure 12:
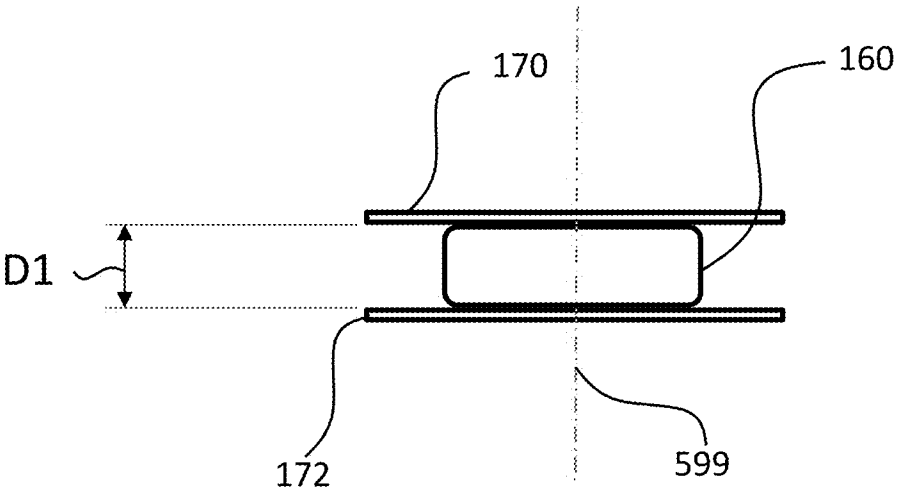
FIGS. 12-13 depict an exemplary magnet management apparatus according to at least some exemplary embodiments.
Figure 13:
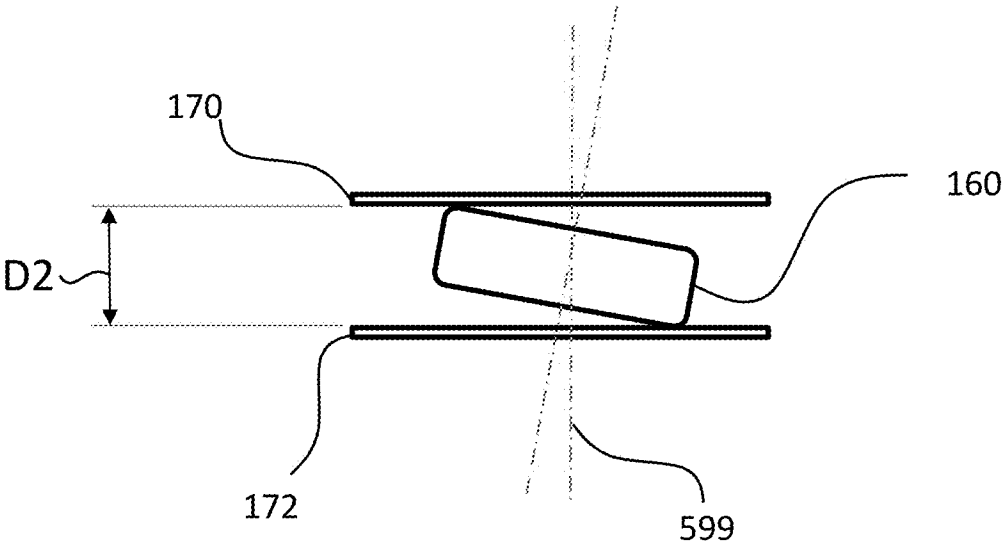

Consistent with the teachings above where the magnet apparatus 160 can include a container, such as a housing, in which a magnet is located, and thus, in some exemplary embodiments, the implantable component 100 enables the magnet of the magnet apparatuses to revolve relative to the container. In an exemplary embodiment, such as that of a disc magnet, the magnet can revolve in the plane of the magnet. It is further noted that in some exemplary embodiments, the device is configured to enable the magnet of the magnet apparatus 160 to tilt relative to the wire of coil 137 and/or change a distance relative to the wire of the coil 137. That is, the magnet can move out of the plane of the magnet. With regard to tilting, in an exemplary embodiment, plates sandwich a disk magnet, and the plates permit the disk of the magnet to tilt. In this regard, in an exemplary embodiment, the arrangements of U.S. Patent Application No. 62/174,788, filed on Jun. 12, 2016, to Roger Leigh as an inventor, entitled Magnet Management MRI Compatibility, can be utilized with the magnet apparatuses herein. Briefly, FIG. 12 depicts an exemplary embodiment utilizing plates 170, where an elastomeric material such as the silicon of the housing surrounds the plates and holds the plates in place against the magnet 160. As can be seen, the plates 170 and 172 are located a distance D1 from each other. In an exemplary embodiment, distance D1 corresponds to the thickness of the magnet (as differentiated from the width of the magnet, which corresponds to the diameter of a disc magnet, which can be a disk magnet, as measured on a plane normal to the longitudinal axis 599). That is, in an exemplary embodiment, the plates are located in direct contact with the opposite faces of the magnet apparatus 160. In an exemplary embodiment where the opposite faces of the magnet apparatus are parallel, the surfaces of the plates 170 and 172 facing each other are also parallel, as those surfaces are also flat surfaces. As noted above, the elastomeric material surrounding the plates holds the plates against the magnet apparatus 160. That is, in an exemplary embodiment, the housing made from elastomeric material 199 is arranged such that when the magnet apparatus 160 is located between the plates, the elastomeric material can impart a downwards and upwards force, respectively, onto the plate 170 and plate 172, thereby imparting a downward and upward force on to the opposite faces of the magnet apparatus 160. When the magnet(s) are exposed to a magnetic field, such as in an MRI machine, in an exemplary embodiment, as seen in FIG. 13, the implantable component 100 is configured such that the plates 170 and 172 are pushed apart from one another due to rotation of the magnet apparatus 160 as a result of the torque applied thereto due to, for example, a 3 T magnetic field. As can be seen, the magnet apparatus 160 rotates such that its longitudinal axis moves from its normal position (the position where the magnet is located in the absence of an external magnetic field. The plates separate a distance D2, which is greater than D1.

Alternatively, and/or in addition to this, the magnet apparatus 160 can move horizontally (left and right relative to the frame of reference of FIGS. 12 and 13). Thus, in an exemplary embodiment, the implantable component 100 is configured to enable the magnet to change a distance relative to the wire of the coil 137.

Figure 14:
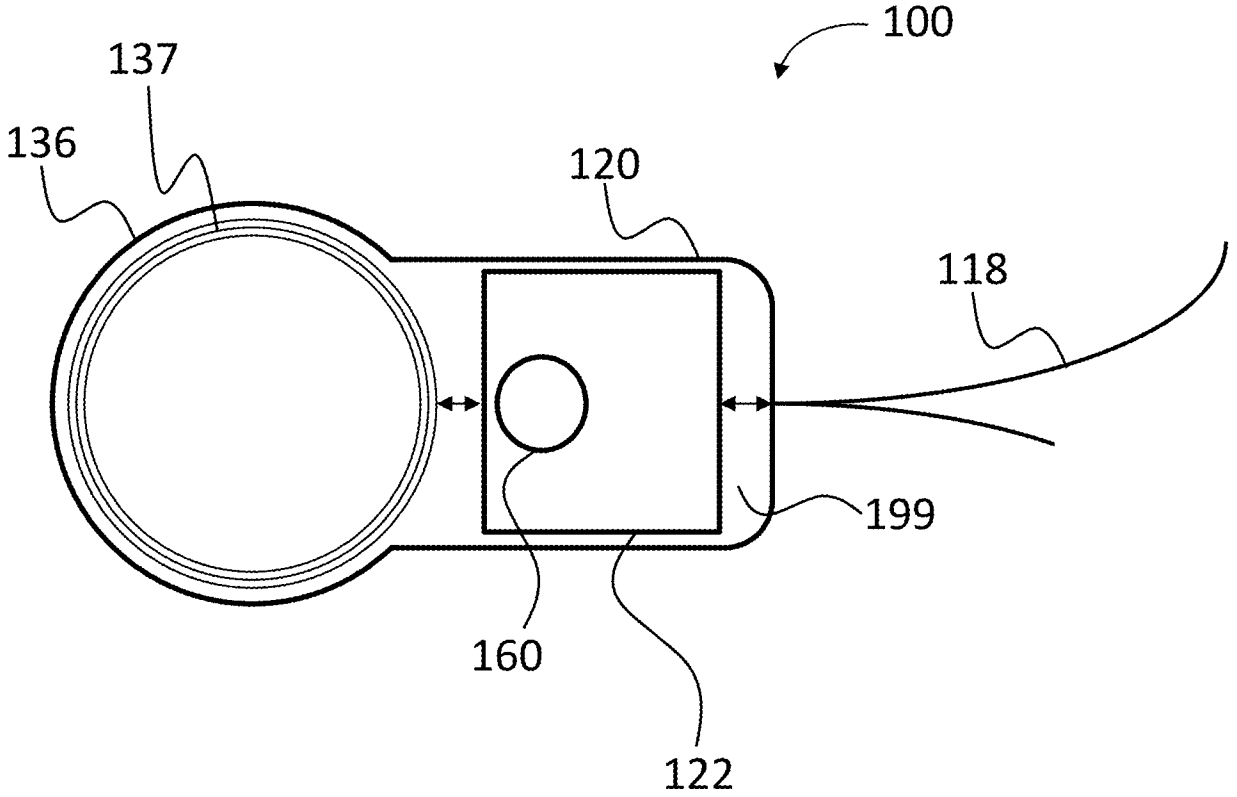
FIGS. 14-19 represent exemplary conceptual schematics of various exemplary embodiments of some implantable components according to the teachings detailed herein.

FIG. 14 depicts an alternate embodiment of an implantable component 100, where the magnet apparatus 160 is located outside of the enclosed area of the coil 137, but also located within the general boundaries of the housing 122. In an exemplary embodiment, the housing 122 is a titanium housing that completely envelops the magnet 160 (making the magnet unremovable in at least some exemplary embodiments). That is, in an exemplary embodiment, the magnet is fully inside the housing 122. In an exemplary embodiment, the magnet is fully hermetically sealed inside the housing 122. That said, in an alternate embodiment, the housing contains a recess into which at least a portion of the magnet apparatus 160 is located. By way of example only and not by way of limitation, the housing can include a through hole (or through tunnel), where the walls of the hole (tunnel) form walls of the housing that permit the inside of the housing to remain hermetically sealed despite a hole passing through the housing from one side to the other. That said, in an exemplary embodiment, the hole only goes through a portion of the thickness of the housing. In an exemplary embodiment, the hole can be female threaded to receive threads of the magnet apparatus 160 so that the magnet apparatus 160 can be screwed in and out of the housing, thus enabling removal and re-insertion of the magnet apparatus 160 to and from the housing 122, and thus to and from the implantable component 100. In an exemplary embodiment, the housing 199 completely envelops the housing 122 and the magnet 160. In an exemplary embodiment, the housing 199 stops at the edges of the hole for the magnet 160. In an exemplary embodiment, the housing 199 extends over a portion of the magnet beyond the boundary of the magnet. In an exemplary embodiment, there is a slit in the housing 199 to enable the magnet to pass through the housing 199. Any arrangement that can enable the magnet to be removed and replaced can be utilized in at least some embodiments.

Figure 15:
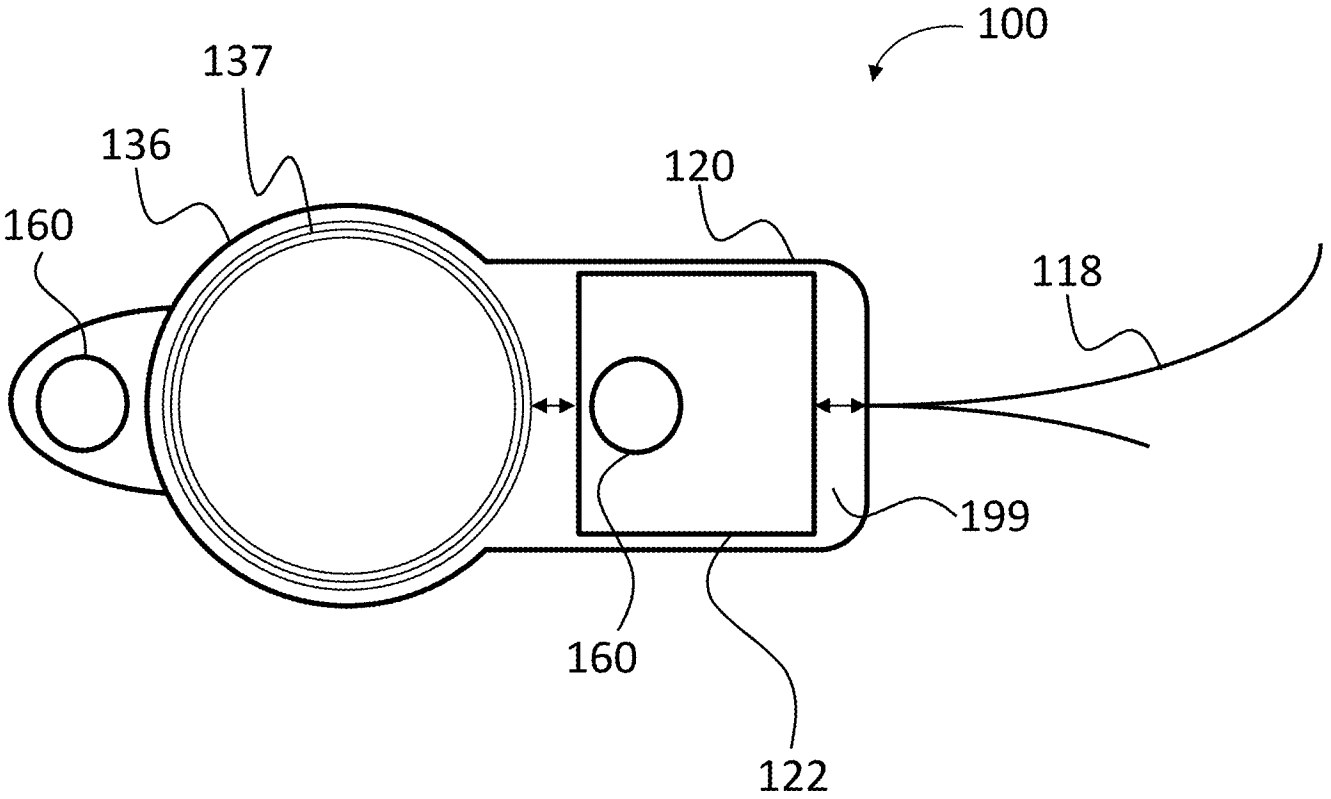

FIG. 15 depicts an alternate embodiment where a magnet 160 is located in the housing 122 and a magnet 160 is located on the opposite side of the coil 137 outside the housing 122.

Figure 16:
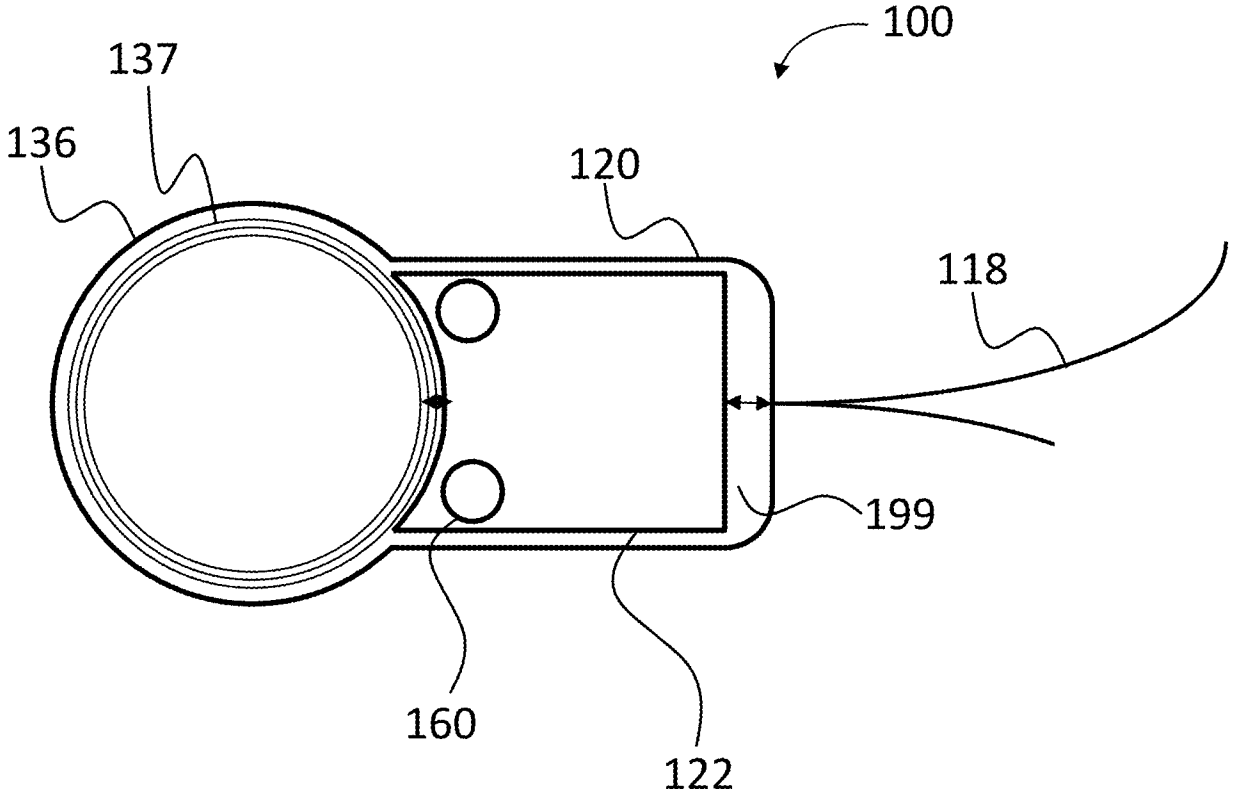

FIG. 16 depicts an exemplary embodiment where the housing 122 has a more complex shape as can be seen and accommodates two separate magnets 160 arrayed symmetrically about the longitudinal axis of the implantable component 100. In an exemplary embodiment, the housing 122 has been extended in the manner shown towards the coil 137 so as to move it the magnets 160 closer to the geometric center of the coil 137. In some exemplary embodiments, this has utilitarian value with respect to establishing a magnetic field that more accurately aligns the external component in general, and the coil thereof in particular, with the coil 137 of the implantable component 100.

It is to be understood that three or more magnets can be located in the housing 122. Is also noted that as is the case with the embodiments where the magnets are located outside the housing 122, the magnets located inside the housing 122 can revolve, and/or rotate, and/or move so as to increase and/or decrease distance relative to the coil 137.

Figure 17:
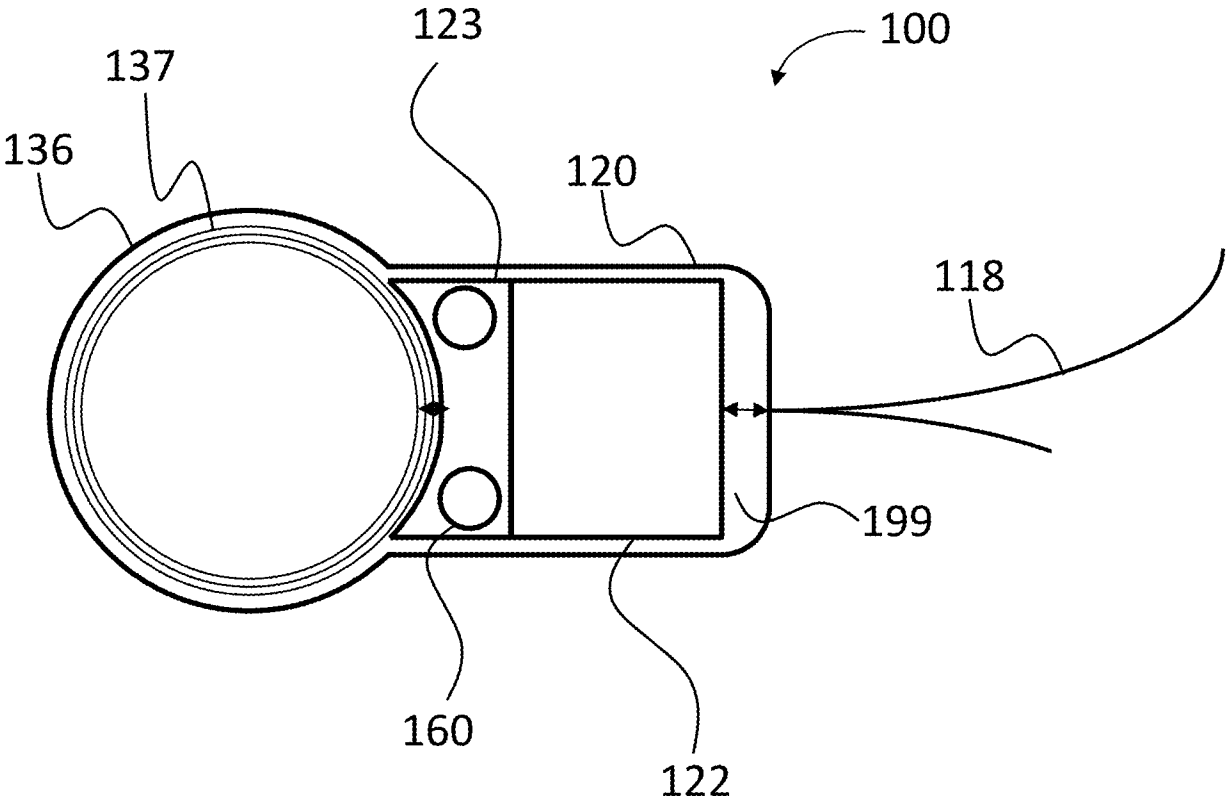

It is also noted that some embodiments can be practiced where the magnet apparatuses 160 are directly coupled to the housing without being in the housing and/or without at least a portion of the housing enveloping at least a portion of the magnet apparatus 160. In an exemplary embodiment, a separate housing can house the magnets 160, such as housing 123 seen in FIG. 17. In this exemplary embodiment, the housing 123 is attached to the housing 122. In an exemplary embodiment, the housing 123 is removably coupled to the housing 122. That is, in an exemplary embodiment, the housing 123 can be decoupled from the housing 122. In an exemplary embodiment, the housing 123 can subsequently be re-coupled to the housing 122. In an exemplary embodiment, the device 100 is configured to enable the housing 123 to be completely removed from the device and then re-inserted in the device.

In view of the above, in an exemplary embodiment, there is an implantable device, such as implantable component 100, that includes a receiver-stimulator electronics package, such as the receiver-stimulator assembly detailed above, that is configured to receive a signal from the coil 137 and analyze that signal and develop and output stimulation signal to be outputted to array assembly 118 to evoke a hearing percept. That said, in an exemplary embodiment, the receiver-stimulator electronics package is configured to output an electrical current to a mechanical actuator to actuate the mechanical actuator to induce vibrations into the recipient or otherwise move a component of the recipient's ear so as to evoke a hearing percept. In an exemplary embodiment of this exemplary embodiment, there is also a hermetically sealed housing, such as housing 122, and in an exemplary embodiment, the receiver-stimulator electronics package is located in the housing, and a magnet is also located in the housing. In an exemplary embodiment, a plurality of magnets are also located in the housing.

In an exemplary embodiment, instead of, or in addition to magnets located in housing 122, the magnet or magnet assembly of which the magnet is a part is directly removably coupled to the housing 122.

Figure 18:
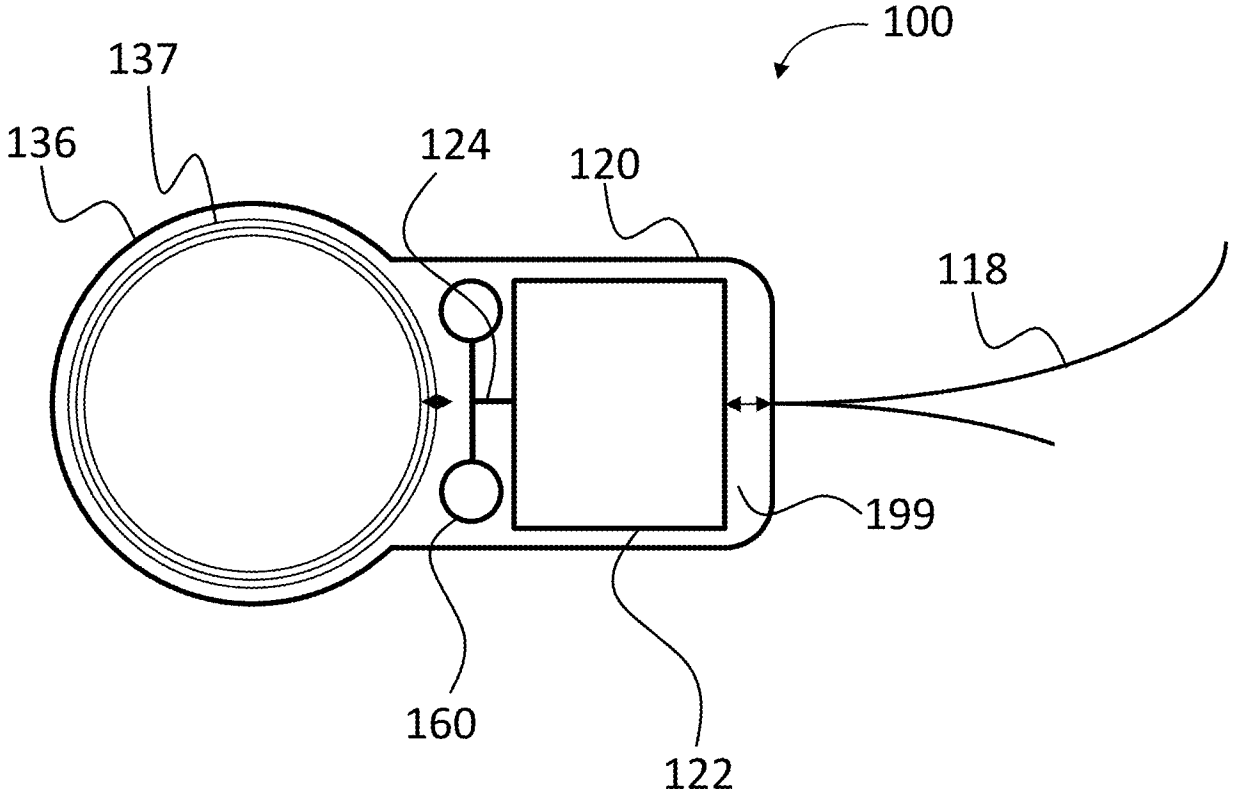

FIG. 18 depicts an exemplary embodiment of a plurality of magnets 160 located in the housing 199 that are connected to each other by a beam assembly that is connected to housing 122 to provide locational stability beyond that which is afforded by the housing 199. In an exemplary embodiment, the magnets 160 are removable from the beam assembly and/or the beam assembly is removable, with or without the magnets, from the housing 122.

Figure 19:
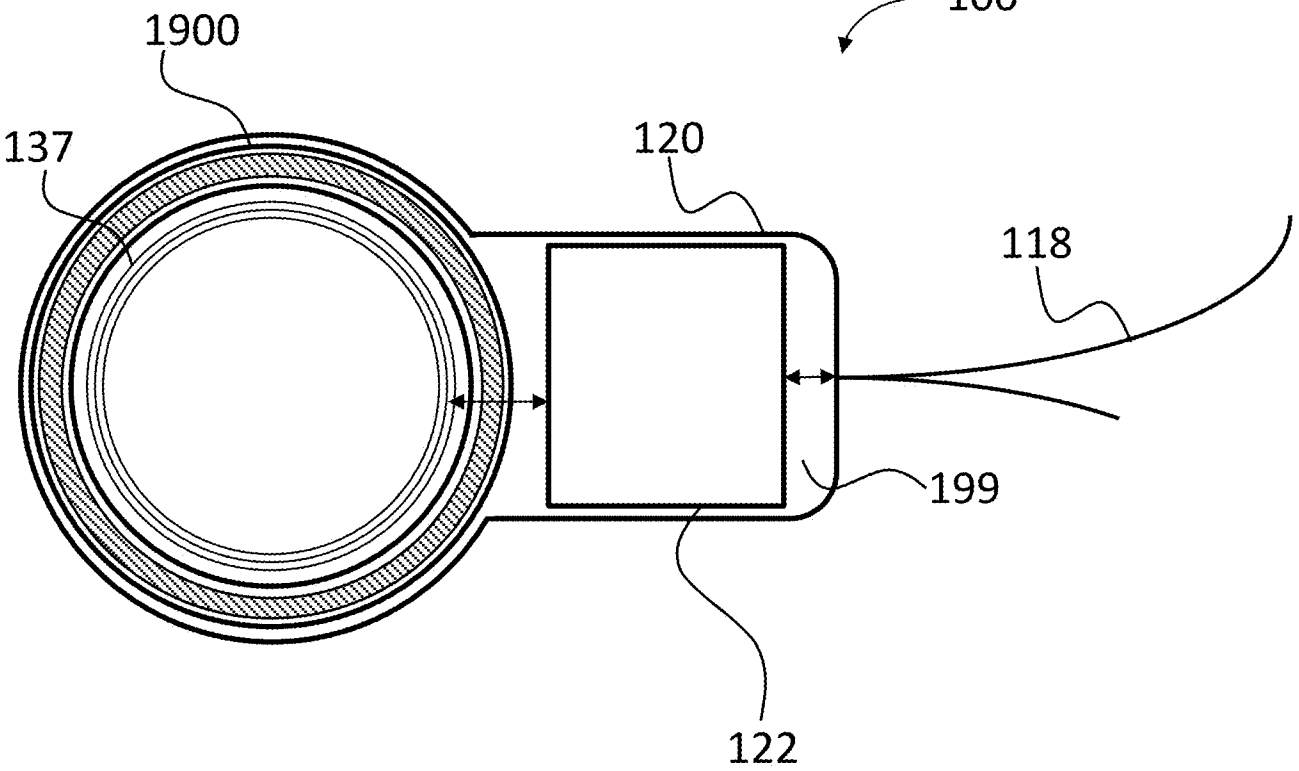
Figure 20:
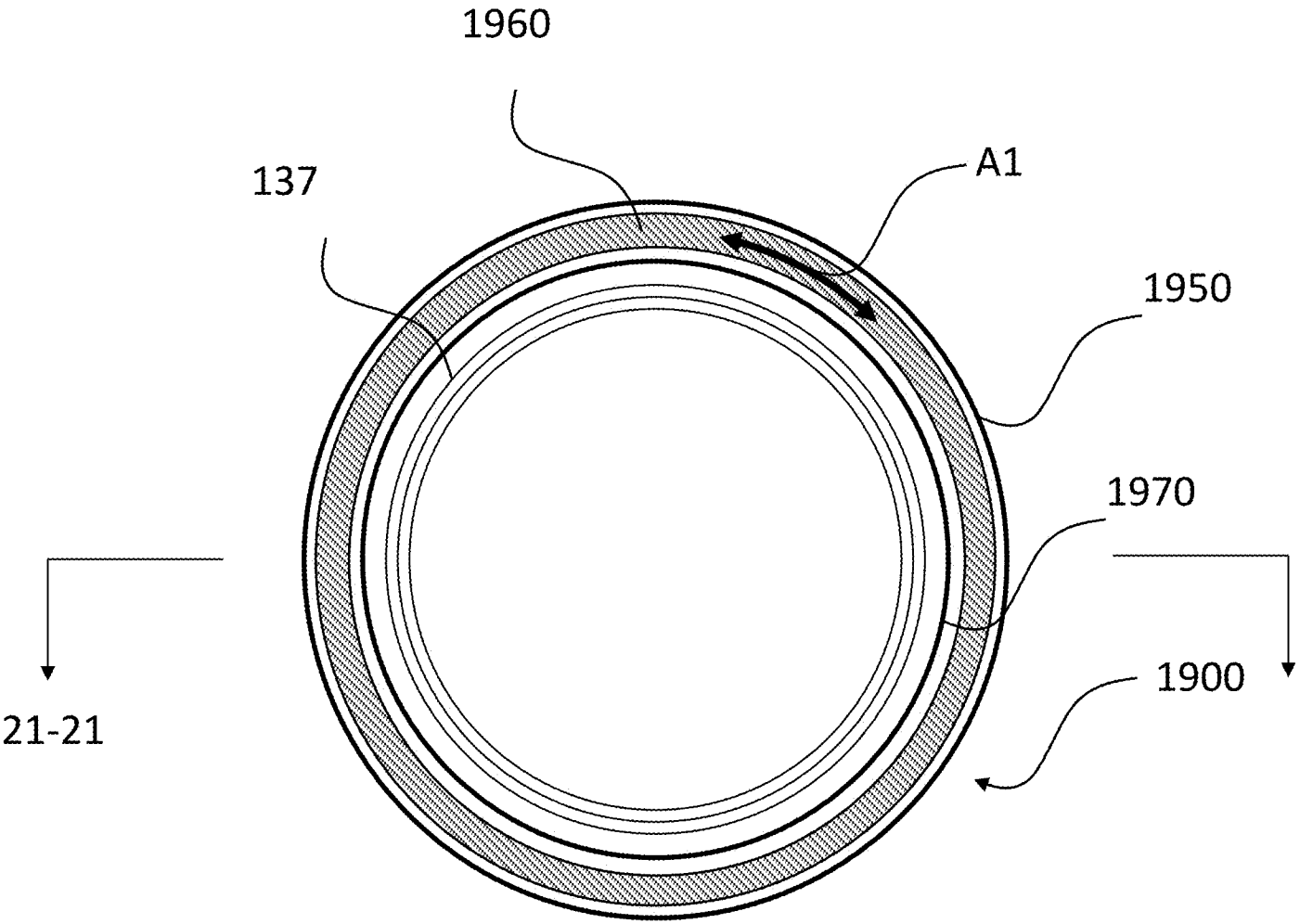
FIGS. 20 and 21 represent exemplary additional details of some of the features of the embodiment of FIG. 19.
Figure 21:
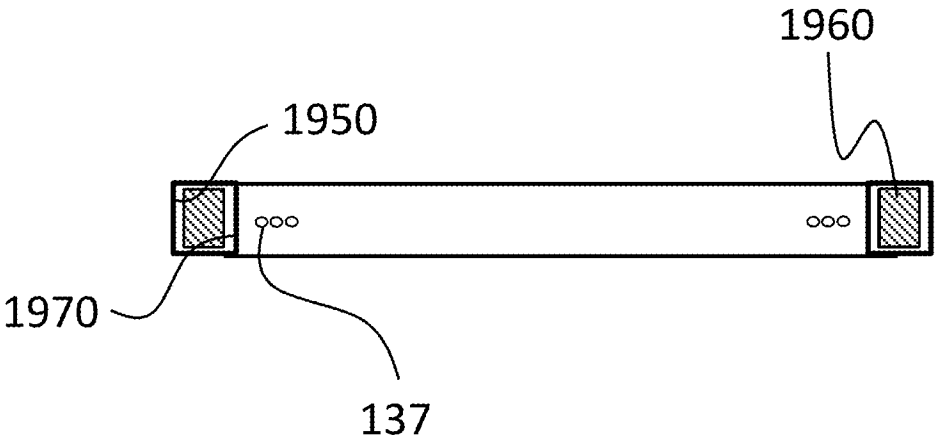

FIG. 19 depicts an alternate embodiment of an implantable component 100, wherein a magnet apparatus 1900 is located outside the boundaries of the coil 137. Here, the magnet of the magnet apparatus 1900 is a ring the magnet or a doughnut magnet. FIG. 20 provides additional details of the magnet apparatus 1900, along with the coil 137 superimposed therein. FIG. 21 provides a cross-sectional view of the magnet apparatus 1900. With respect to FIGS. 20 and 21, it can be seen that a magnet 1960 in the form of a ring is located inside a ring-shaped container having a rectangular cross-section through the ring. The ring-shaped container includes an inner wall 1970 and an outer wall 1950. Along with top and bottom walls, the ring-shaped container can hermetically seal the ring magnet 1960 therein. In an exemplary embodiment, the ring-shaped container does not hermetically seal the ring magnet 1960 therein, but simply holds the magnet 1960 therein. It is also noted that while inner and outer and top and bottom walls of the ring container are shown in this embodiment, in an alternate embodiment, one or more these walls can be eliminated. With reference to FIG. 20 and arrow A1, it is to be understood that the magnet 1960 can revolve within the container. In this regard, there is utilitarian value with respect to permitting the magnet to revolve when exposed to a magnetic field. That said, in an alternate embodiment, the ring magnet 1960 is fixed relative to the coil 137. Also, in an exemplary embodiment, instead of the container, a membrane or the like can be located about magnet 1960 for purposes of biocompatibility etc.

In at least some exemplary embodiments, the interior of the container at least generally conforms to an exterior of the magnet 1960. That said, in some alternate embodiments, the ring-shaped magnet and/or the container do not conform generally to one another.

While the embodiment of FIG. 19 depicts the ring-shaped magnet extending about the coil 137, in an exemplary embodiment, the ring-shaped magnet can be located such that it does not extend about the coil 137.

In view of the above, in an exemplary embodiment, there is an implantable component 100, or any other medical device that is implantable, that includes a ring-shaped magnet, and a functional component of the implantable medical device, an actuator, etc. In an exemplary embodiment, the device is configured to enable the magnet to revolve and/or the functional component is an electromagnetic communication coil and the magnet extends about the coil.

Figure 22:
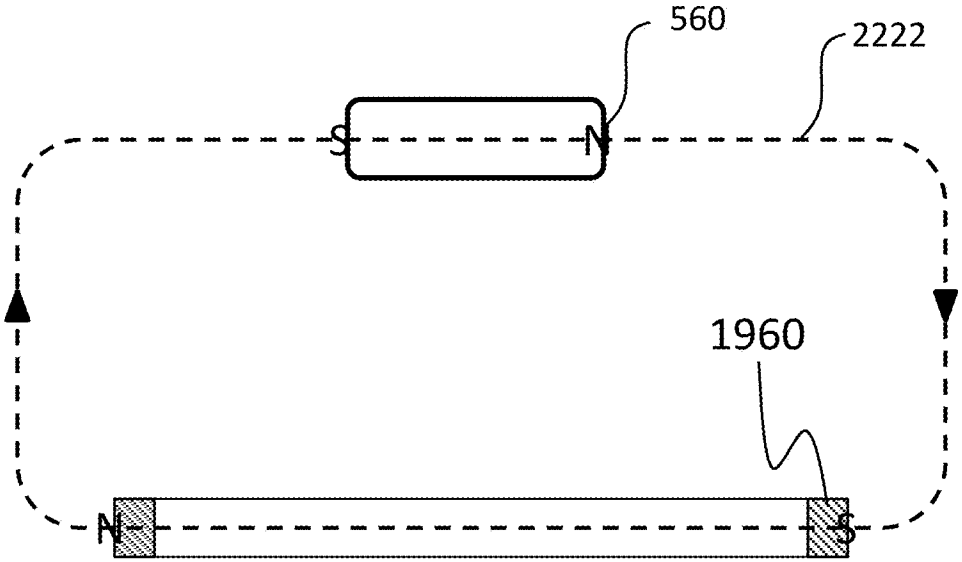
FIGS. 22 and 23 quasi-conceptually depict the magnetic field path(s) according to some of the embodiments detailed herein.
Figure 23:
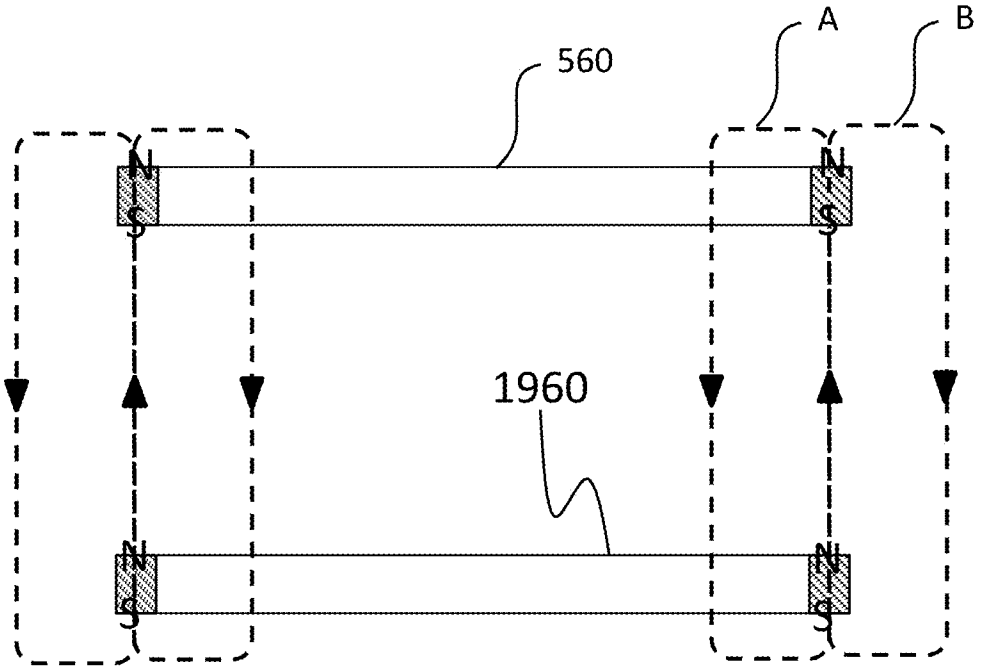

In some embodiments, the ring-shaped magnet 1960 is polarized in-plane in a manner analogous to the arrangement of FIG. 6. This is depicted in FIG. 22, where the magnet of the external component 560 is magnetically coupled to the magnet 1960. As can be seen, the magnetic field lines 2222 travel from north to south of the respective magnets. FIG. 23 depicts an arrangement where the magnet 1960 is out of plane polarized. Also depicted is a ring-shaped magnet 560 of the external device, which can also encompass the coil of the external device. The magnetic field lines that interact between the two magnets are also depicted. It is also noted that in at least some exemplary embodiments, a different type of magnet can be utilized for the external device. For example, a series of plate magnets and/or spherical magnets can be utilized that are arrayed in a ring if the poles and magnetic field densities will work out in an acceptable manner. Such is also the case with respect to the internal device. These arrays of magnets can be arrayed about the coil as shown above in FIG. 11. In this regard, any arrangement of any magnet that can interact with any arrangement of any other magnet can be utilized in at least some exemplary embodiments providing that such enables the teaching detailed herein.

It is briefly noted that any embodiment detailed herein with respect to an implantable component can be utilized with respect to the external component, and vice versa.

Figure 24:
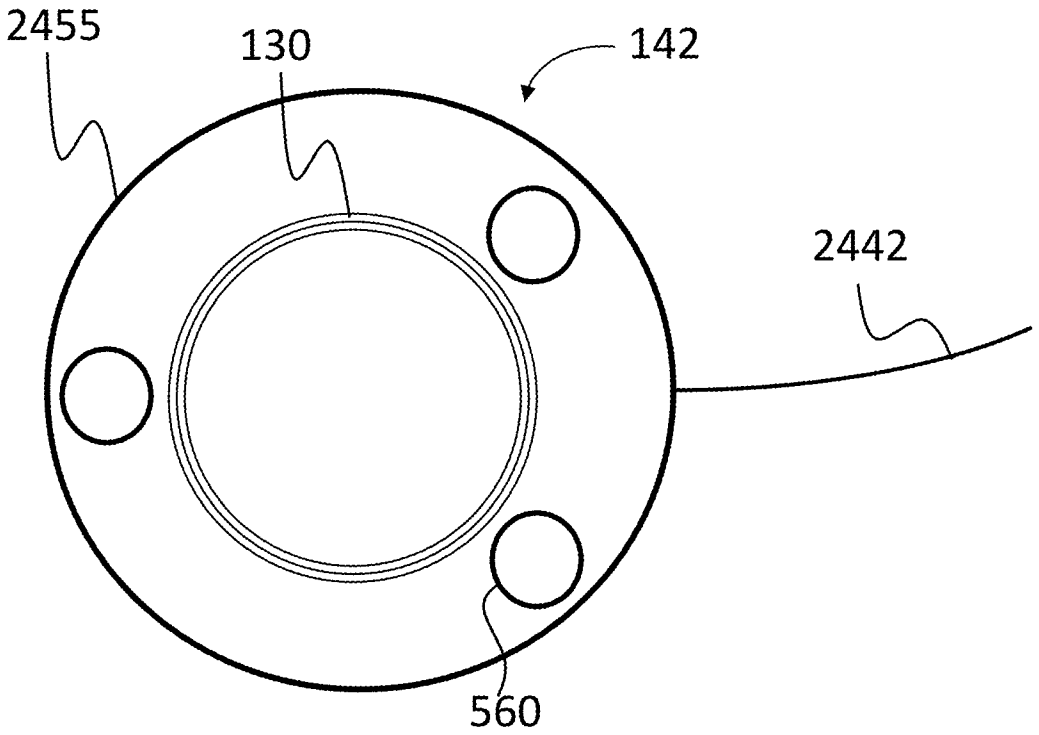
FIGS. 24 and 25 represent exemplary conceptual schematics of various exemplary embodiments of some external components according to the teachings detailed herein.

FIG. 24 depicts an exemplary external component 142 including the external coil 130 configured to interface with the skin of the recipient and be held thereagainst via interaction with the magnetic fields generated by the magnets of the implantable component. The embodiment of FIG. 24 is configured to interact with the embodiment of FIG. 10A above, and thus has three magnets 560 symmetrically or at least substantially symmetrically arrayed about the coil 130. The magnets 560 can be included in a polymer component 2455, such as a plastic housing that also includes the coil 130. The coil 130 can be in signal communication with the BTE device or the like via cable 2442. As can be seen, the magnets 560 are arranged in a manner that mirrors the arrangement of the magnets 160 and 160A of the embodiment of FIG. 10A. That said, it is noted that in at least some other exemplary embodiments, the magnets are arranged in a manner that does not mirror the arrangement of magnets of the implantable component. Indeed, as noted above, in some exemplary embodiments, different configurations of magnets can be utilized in the external component than that utilized in the internal component. Any arrangement that can enable the external component to be held against the skin of the recipient via magnetic attraction with the implantable component and/or that can enable the external coil to be aligned with the implantable coil can be utilized in at least some exemplary embodiments.

Figure 25:
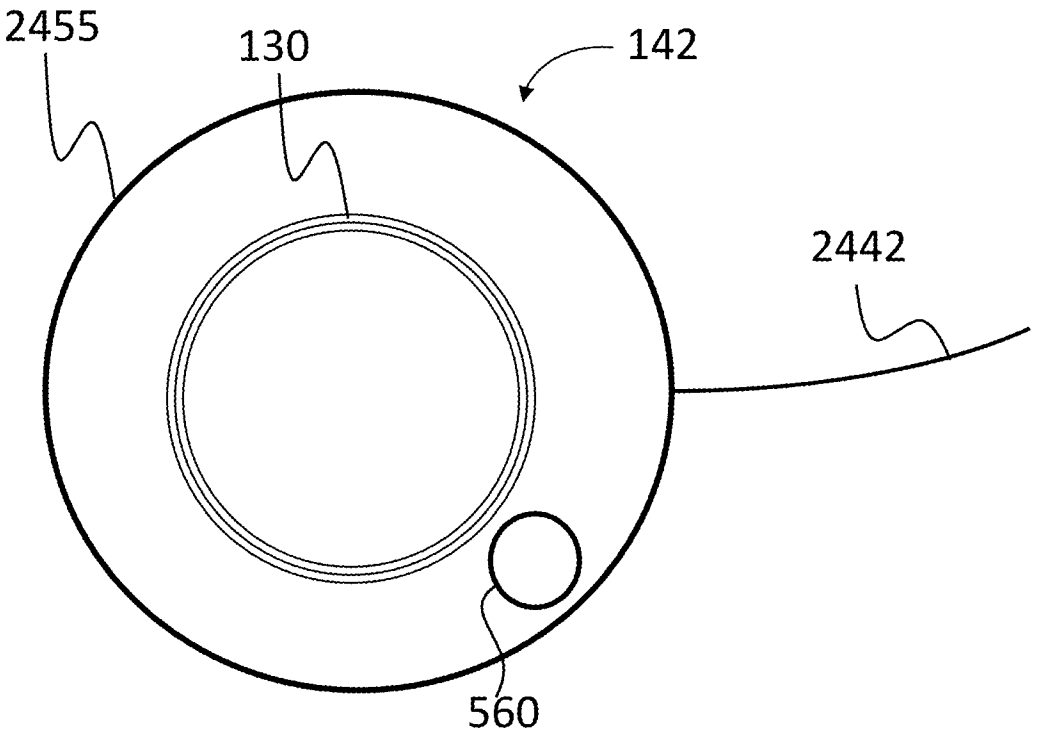
Figure 26:
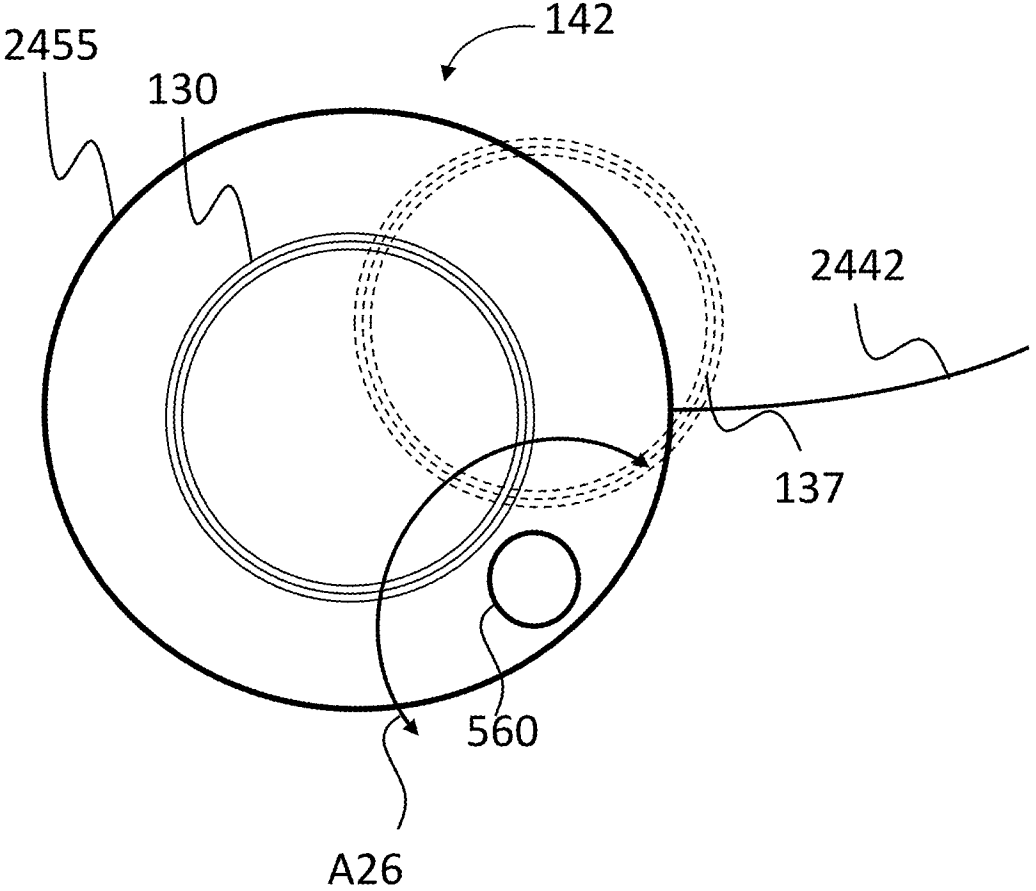
FIG. 26 depicts a conceptual schematic of coil misalignment and the utilitarian feature of the magnet as used herein in some embodiments to self-align the external coil with the implantable coil.

Briefly, FIG. 25 depicts an exemplary embodiment of an external component 142 configured to be adhered against the skin of the recipient so as to magnetically interact with the implantable component of FIG. 7A. In such exemplary embodiments where there is only one magnet, the structure of the housing 2455 can be such that it is rigid enough to span the distance from the magnet to the other side of the coil 130 to maintain the coil 130 at least roughly parallel to the coil 137 implanted in the recipient. It is also noted that in at least some exemplary embodiments, in-plane polarization is utilized so as to keep the external component aligned with the implantable component with respect to rotation about the longitudinal axis of the magnet 560 of the external component (which extends into and out of the page on which FIG. 25 is printed). That is, because there is only one magnet, and the magnet is offset from the center of the coils 130 and/or 137, the angular orientation of the external component can change about the longitudinal axis of the magnet. This is depicted by way of example only and not by way of limitation in FIG. 26, where the external component is superimposed over the implanted coil 137, and arrow A26 depicts how the external component 142 can rotate about the longitudinal axis of magnet 560. Utilizing the in-plane arrangement, the in-plane polarization can be utilized to align the external coil with the implantable coil and thus prevent such misalignment.

It is also noted that in at least some exemplary embodiments, spherical magnets can be utilized alternatively and/or in addition to the disc or plate magnets detailed herein. Any magnet arrangement that can enable the teachings detailed herein can be utilized in at least some exemplary embodiments.

Exemplary embodiments also include methods of holding an external component of a transcutaneous communication device against skin of a recipient. In this regard, in an exemplary embodiment, there is a method of holding an external component, such as external component 142, including a first electromagnetic communication coil (e.g., coil 130) against skin of a recipient via a magnetic coupling extending from a first magnet (e.g., magnet 560) outside the recipient to a second magnet (e.g., magnet 160) implanted beneath the skin of the recipient. In an exemplary embodiment, with respect to a plane lying on a longitudinal axis extending between the first and second magnets, an entire arcuate magnetic field path of the magnetic coupling extending from a pole of the first magnet to a pole of the second magnet bypasses a second electromagnetic communication coil implanted in the recipient, wherein the first and second coils are substantially coaxial with one another. Exemplary embodiments of such magnetic fields are presented in FIGS. 22 and 23. As can be seen, the magnetic field path between the North Pole of magnet 560 and the South Pole of magnet 1960 bypasses the coil of the implantable component, where the coil is located inside the inner perimeter of the ring magnet 1960. This is also the case with respect to the path between the North Pole of magnet 1960 and the South Pole of magnet 560. With respect to FIG. 23, while there is a path between the North Pole of magnet 560 and the South Pole of magnet 1960 that does extend through the coil located inside the inner perimeter of the ring of magnet 1960 (path A), there is also a path (path B) that extends from the North Pole of magnet 562 the South Pole of magnet 1960 that bypasses the electromagnetic communication coil of the implantable component when the coil is located inside the ring of magnet 1960.

It is noted that there can be utilitarian value with respect to utilizing to magnets in the external component and/or in the implantable component beyond that related to reducing the size of the magnets and/or the magnetic field of any individual magnet. In this regard, utilization of two or more magnets can be utilized to align the external device with the implantable device in general, and thus the external coil with the implantable coil in particular. More specifically, in the case of one magnet that is offset from the coil, in at least some instances, while the magnetic field between the external magnet in the implantable magnet will result in the external component being held against the skin, the coils may not necessarily be aligned. However, if two or more magnets are utilized, the magnetic field will drive alignment of both magnets of the external component with both magnets of the implant with respect to rotation about the plane that is tangent to the surface of the skin, thus driving the external component to be aligned with the implantable component, and thus the external coil to be aligned (e.g., coaxial) with the implantable coil.

Note further that in at least some exemplary embodiments, the utilization of two or more external magnets can permit the aforementioned alignment even when the implantable component is configured so as to enable one or more or all of the implantable magnets to revolve within the containers or otherwise move. Indeed, in an exemplary embodiment, the external component will, in part, force the implantable magnets to align within the implantable component in a manner that permits the external component to interface with the magnetic field of the implantable component so as to have the respective coils aligned according the teachings detailed herein, while also preventing the misalignment of the coils. It is noted that in at least some exemplary embodiments, the magnets of the external component can also revolve. Any disclosure herein relating to the implantable component can be applied to the external component, and vice versa.

Figure 27:
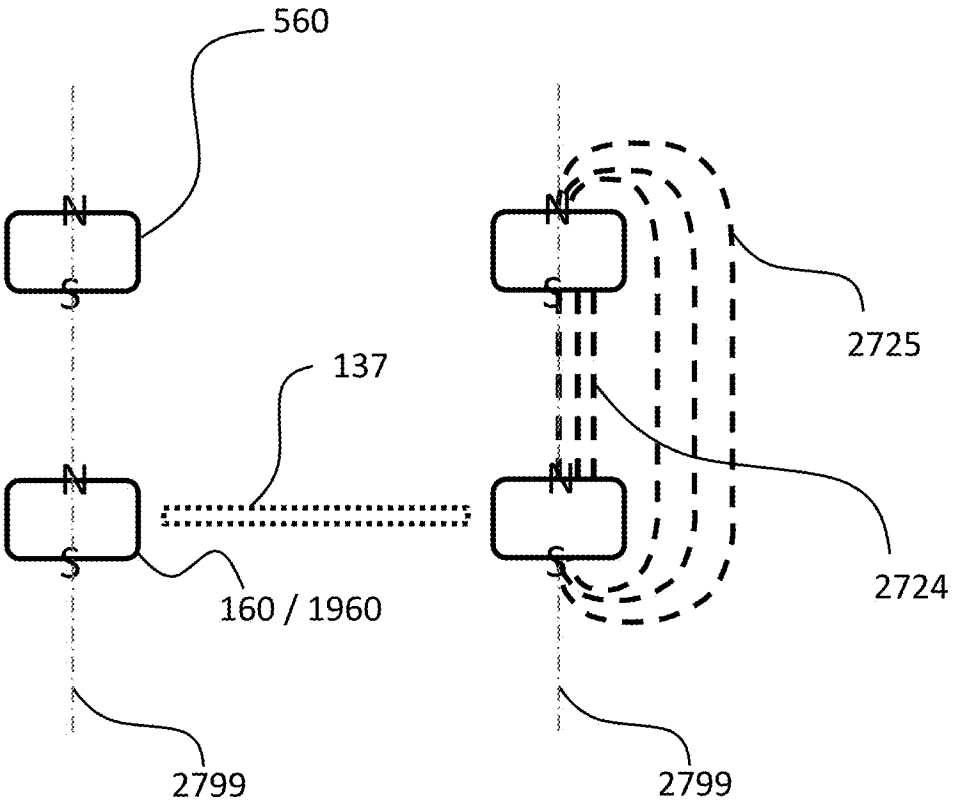
FIGS. 27-30 quasi-conceptually depict the magnetic field path(s) according to some of the embodiments detailed herein.
Figure 28:
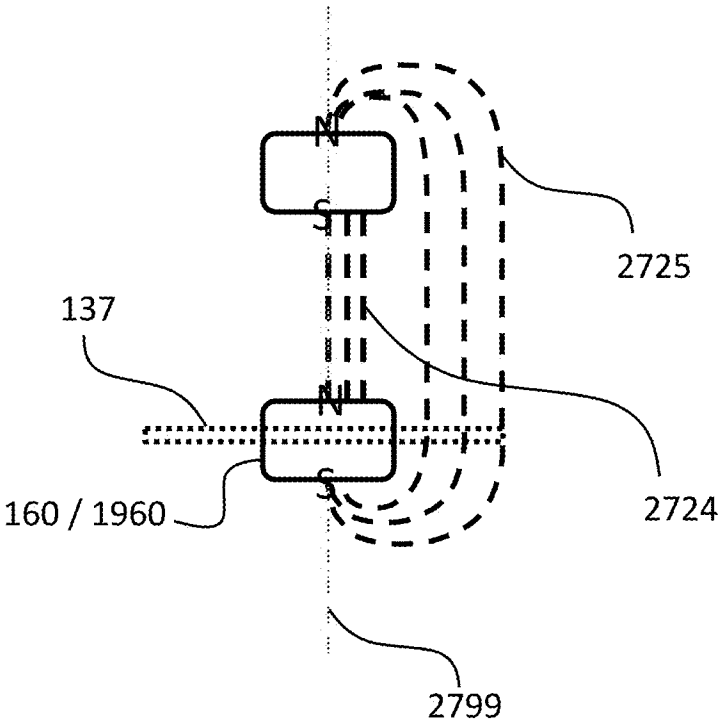

FIG. 27 depicts a more detailed view of the arcuate magnetic field between the external magnet(s) and the implanted magnet(s). It is noted that FIG. 27 can represent both a ring magnet configuration and a multi-magnet configuration (here two separate magnets). That is, FIG. 27 can be considered a cross-sectional view of a single ring magnet with the back-component (the part that is behind the cross-section/behind the page) or the cross-section of two separate magnets (disk magnets) where the cross-section constitutes the widest part of the magnets (and thus the portion of the magnet that extend behind the page are eclipsed by the cross-section). This is as contrasted to FIG. 28, which shows the arcuate path 2725 that intersects with the coil 137. Note that there is a path 2742 that does not intersect with the coil 137. However, that is not an arcuate path. In this regard, an arcuate path is to be understood as a path having an arc, and path 2724 does not have an arc. Note further that the paths 2725 are 180 degree plus arcuate magnetic field paths, because the field makes more than a 180 degree turn (in fact, they make a 360 degree turn). In some embodiments, the entire arcuate path makes more than a 90 degree turn, or more than an 80 degree turn. In an exemplary embodiment, the turn is equal to or more than 30, or 40, or 50, or 60, or 70, or 80, or 90, or 100, or 110, or 120, or 130, or 140, or 150, or 160, or 170, or 180, or 190, or 200, or 210, or 220, or 230, or 240, or 250, or 260, or 270, or 280, or 290, or 300, or 310, or 320, or 330, or 340, or 350, or 360 degrees, or any value or range of values therebetween in 1 degree increments.

Figure 29:
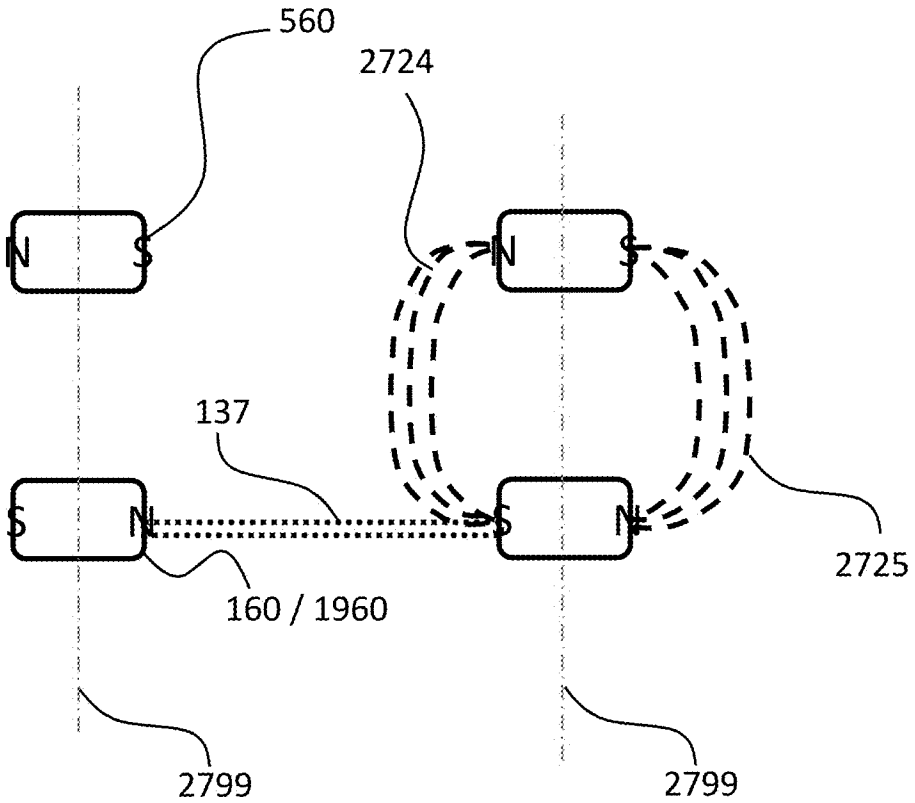
Figure 30:
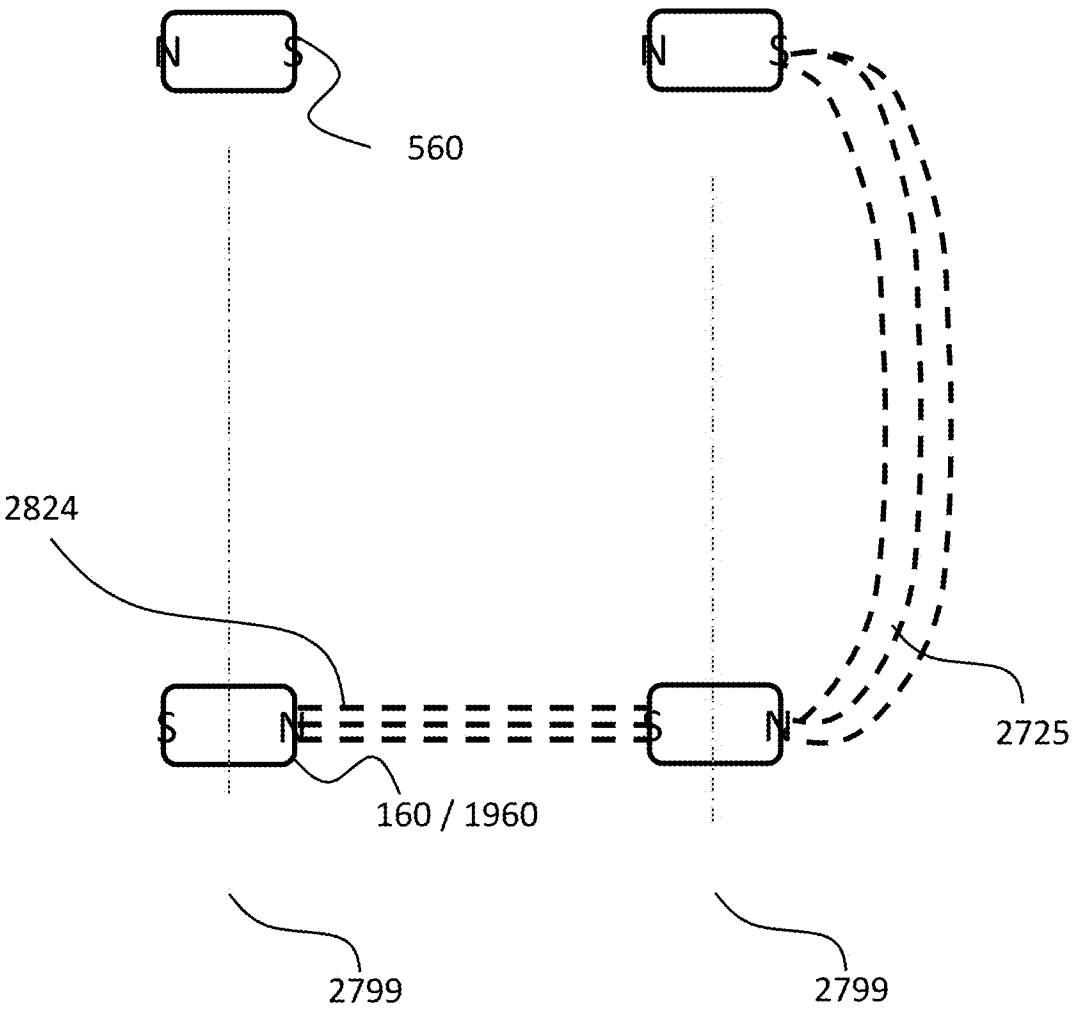

FIG. 29 depicts magnets utilizing the in-plane polarization, where the configuration of FIG. 29 can be representative of a ring magnet or a plurality of disk magnets. Not shown for clarity is the coil located between magnets 160/1960. However, as can be seen, respect to a plane lying on a longitudinal axis extending between magnet 560 and magnet 160/1960 (e.g., on the plane of the page of FIG. 29), the arcuate magnetic field path 2725 makes 180 degree turn from the North Pole of the implanted magnet to the South Pole of the magnet of the external component, and this occurs by bypassing the electromagnetic communication coil located between the implanted magnets (or that is surrounded by the ring magnet). Path 2724 has similar characteristics. Note further that these paths are distinguished from path 2824 of FIG. 30, which exists if the vertical separation of the magnets is significantly greater (i.e., very thick skin and/or deeply implanted magnet) than that which exists with respect to the scenario of FIG. 29, where path 2824 is not arcuate, and to the extent it contains an arcuate portion, that portion does not turn more than a few degrees, and thus it is not a 90° or more arcuate magnetic field path (or not even a 30 degree or more arcuate magnetic field path) and certainly not a 180° or more arcuate magnetic field path.

Conversely, if the magnet 160 was located inside the coil 137, even with the in-plane polarization, path 2725 would not bypass the coil 137.

In a more detailed version of the above-noted method, subsequent to the action of holding the external component to the skin of the recipient, the method further includes removing the second magnet from the recipient by detaching a magnet assembly of which the magnet is a part from direct coupling with an implanted housing containing electronics and in signal communication with the coil. In an exemplary embodiment, such a method can be executed utilizing the configuration of FIGS. 14 to 18, by way of example only and not by way of limitation. In an exemplary embodiment, the assembly of which the magnet, the second magnet, is a part is configured so that the magnet is located in a container and the magnet revolves within the container implanted in the recipient. Still further, in an exemplary embodiment, consistent with the teachings detailed above, a spherical magnet can be utilized. In an exemplary embodiment, the spherical magnet can revolve about all axes thereof.

Also consistent with the teachings above, in an exemplary embodiment, the external component includes a single magnet (i.e., only one magnet) located off-center from the first electromagnetic communication coil of the external component, wherein the single magnet establishes in part the magnetic coupling, and the single magnet orientates the external component so that the first and second coils are substantially coaxial with one another. In this regard, in an exemplary embodiment, an in plane polarity of the one and only magnet of the external component can be utilized. In an exemplary embodiment, the plane that extends through the north-south pole axis of the magnet of the external component also extends through the north-south pole axis of a magnet of the implantable component. In this regard, the north-south pole planes of the two magnets are aligned (the planes are parallel and in contact with each other). Owing to the principles of magnetism, movement of the magnet of the external component (and thus movement of the external component) in a manner such that the magnet of the external component (and thus the external component) will be driven back to an arrangement where the north-south pole plane of the external component is parallel to and in contact with the north-south pole plane of the magnet that is implanted into the recipient. In an exemplary embodiment where the two magnets remain coaxial with one another, but the respective north-south pole planes establish an angle relative to one another, the magnetic fields will operate to reduce that angle to zero so that the planes are parallel to one another and in contact with one another. Utilizing sufficient dimensioning arrangements of the external component in general, and positioning the external coil relative to the magnet of the external component in a utilitarian manner in particular, this principle will drive the external coil to be coaxial with the implantable coil even when the coils are misaligned at initial placement of the external component against the skin of the recipient.

While the embodiment just detailed utilizes a single magnet in the external component, it is noted that some other embodiments can utilize a plurality of magnets in the external component. Also, the implantable component can utilize one and only one magnet or can utilize more than one magnet. Thus, in an exemplary embodiment, there is a prosthesis comprising an implantable medical device which includes an electromagnetic communication wire that is in the form of a coil. The prosthesis further includes an external component including a second electromagnetic communication coil and a second magnet, wherein the second magnet is located off-center from the second electromagnetic communication coil (e.g., non-coaxial with the coil). In this exemplary embodiment, the second magnet orientates the external component so that the coil of the second electromagnetic communication coil and the coil of the implantable medical device are substantially coaxial with one another.

The teachings detailed herein can have utilitarian value with respect to improving an RF link efficiency between the external coil and the implantable coil. By way of example only and not by way of limitation, in an exemplary embodiment, the magnet of the implantable component is at a first distance from the coil thereof (measured from any consistent point of either component), and the magnetic attraction force between the magnet of the external component (or a magnet of the external component) and the magnet of the implantable component (or a magnet and the implantable component) is a first value, and, all other things being equal, an RF link efficiency is at least about 5% above that which would otherwise be the case if a portion of the arcuate magnetic field path extends through the coil. By all other things being equal, it is meant that if the portion of the arcuate magnetic field extended through the coil, but the magnet was at a same distance from the coil and on the same plane as the coil, etc., the same magnets were used, etc., the RF link efficiency would be different. In an exemplary embodiment, all other things being equal, and RF link efficiency is at least about 10% above that which would otherwise be the case of a portion of the arcuate magnetic field path extended through the coil.

In an exemplary embodiment, all other things being equal, an RF link efficiency is at least about 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 35%, 40%, 45%, or 50% or more, or any value or range of values therebetween in 0.1% increments above that which would otherwise be the case of a portion of the arcuate magnetic field path extended through the coil.

More specifically, the external component 142, which can include a speech processor that detects external sound and converts the detected sound into a coded signal which is sent from an external coil 130 located on the external component 142 to an implantable coil 130 in the implantable component, via a radio frequency (RF) link. The signal can be data, power, audio, or other types of signals, or combinations thereof. The coils, as noted above, can be circular, substantially circular, and also can be, oval, substantially oval, D-shaped, or have other shapes or configurations. The efficiency of power transfer and integrity of the data transmission from one coil to the other is affected by the coil coupling coefficient (k). Coil coupling coefficient k is a unitless value that indicates the amount of the shared magnetic flux between a first coil and a second, coupled (associated) coil. As the amount of shared magnetic flux decreases (i.e., as the coil coupling coefficient k decreases), efficient power transfer between the two coils becomes increasingly difficult. At least some of the teachings detailed herein provide utilitarian value with respect to increasing the coil coupling coefficient k in a system where power and/or data are transferred between two coils, such as by moving the arcuate magnetic field away from the coil.

Some embodiments herein provide that the prostheses maintain a high coil quality factor (Q). Coil quality factor Q is a unitless value that indicates the how much energy is lost relative to the energy stored in the resonant circuit that includes the coil. The teachings detailed herein provide a higher coil quality factor Q, thus indicating a lower rate of energy loss relative to the stored energy of the resonant circuit, relative to that which would be the case without utilizing the teachings detailed herein. Coil quality factor Q can be calculated for an ideal series RLC circuit as depicted in Equation I:

$$Q = \frac{1}{R}\sqrt{\frac{L}{C}} = \frac{\omega_0 L}{R}$$

Where, L is the measured inductance of the coil, R is the measured resistance of the coil, and $\omega_0$=2×Pi×Frequency.

As the coil quality factor Q decreases, it becomes increasingly difficult to transfer power efficiently from one coil to an associated coil. Therefore, it is advantageous to maximize the coil quality factor Q in a system where power is transferred between two coils.

The teachings detailed herein with respect to at least some embodiments permit a higher coil quality factor Q relative to that which results without utilizing such teachings, even while the electronics and batteries are in close proximity to the coil, all other things being equal.

In an exemplary embodiment, all other things being equal, by directing the quarter turn or more (90 degree turn) arcuate fields to avoid the coil(s), in an exemplary embodiment, all other things being equal, Q value is at least about 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 35%, 40%, 45%, or 50% or more, or any value or range of values therebetween in 0.1% increments above that which would otherwise be the case if a portion of the arcuate magnetic field path extended through the coil.

Briefly, as noted above, in some embodiments, the implantable component 100 includes a slit to provide access through the exterior of the implantable component 100 to the location of the magnet apparatus. Thus, according to an exemplary embodiment, there is an implantable medical device, such as a cochlear implant, or other medical device that utilizes a magnet, for whatever reason, comprising a magnet, wherein the silicone body has a slit configured to enable passage of the magnet therethrough. Accordingly, an exemplary embodiment includes a side entry pocket for the magnet apparatus.

It is further noted that in an exemplary embodiment, the arrangements detailed herein can have utilitarian value with respect to reducing (including elimination) of eddy current generation with respect to interaction of the magnetic field with the coil(s). In this regard, in an exemplary embodiment, by placing the magnet outside the area encompassed by the coil, eddy coil generation is reduced relative to that which would be the case if that same magnet (or an equivalent to the combination of magnets outside the coil) were placed inside the area encompassed by the coil. In at least some exemplary embodiments, this can have utilitarian value with respect to achieving the above-noted Q value features.

In an exemplary embodiment, all other things being equal, by practicing one or more of the embodiments detailed herein, in an exemplary embodiment, all other things being equal, eddy current generation is 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 35%, 40%, 45%, 50%, 55%, 60%, 65%, 70%, 75%, 80%, 85%, 90%, 95% or 100% less than or any value or range of values therebetween in 0.1% increments that which would otherwise be the case if a portion of the arcuate magnetic field path extended through the coil and/or the magnet was inside the area of the coil.

In an exemplary embodiment, there can be a slit which is located in a side wall of the housing made of elastomeric material 199. The slit leads through the elastomeric material of the housing made thereof to a location of the magnet apparatus. In an exemplary embodiment, in its relaxed state, the slit has a major axis that is at least about the width of the magnet apparatus 160, whereas the minor axis of the slit can be negligible, if not zero. That is, owing to the resiliency of the elastomeric material from which the housing is made, the slit can be expanded to an expanded state so as to provide an opening of sufficient size to slide the magnet apparatus 160 through the slit 198.

It is noted that in some embodiments, the slit is not provided in the implantable component 100 when implanted in the recipient. In an exemplary embodiment, the slit is provided in the implantable component at the time that the magnet is needed to be removed, via a surgery procedure. Accordingly, in an exemplary embodiment, there is a method of removing the magnet, which entails accessing the implantable component 100 while the implantable component is implanted in a recipient via a surgical procedure, optionally cutting into the body to form the slit, or opening the slit if already present (and closed), removing the magnet apparatus 160, optionally temporarily closing the slit or otherwise sealing the slit, or replacing the magnet with a non-magnetic blank (e.g., a dummy magnet) of similar outer dimensions, conducting an MRI method, re-accessing the implantable component 100, reopening the slit formed therein if the optional temporary closing thereof was executed, replacing the magnet apparatus 160, and closing the slit or otherwise sealing the slit (which closing/sealing can be a compost according to the teachings detailed below in at least some embodiments). Note further that in an exemplary embodiment, the implantable component 100 can include an embryonic slit. That is, the implantable component can include an area that is depressed or otherwise thin relative to other components, which area is proximate a path through the body to a location to where the magnet will finally be located. Because the section is relatively thin, it will be relatively straightforward for the surgeon to cut through the thinned area to reach the path. Alternatively, and/or in addition to this, the body can be marked or otherwise provided on the outside with a curve or a line (dye or with a raised or depressed area) indicating to the surgeon where he or she should cut to form the slit.

In an exemplary embodiment, the aforementioned features regarding the embryonic slits and/or markings can be molded into the silicone.

It is noted that in at least some exemplary embodiments, there is utilitarian value with respect to positioning the magnets as detailed herein in that an implantable magnet that is on the same level as the coil 137 (e.g., the magnet has a plane normal to the longitudinal axis of the implanted magnet and extending through the coils 137) can be removed through the slit or the like without having to take the magnet "over" the coil. That is, in an exemplary embodiment, the implanted magnet can be removed from the implantable component by moving the magnet in the plane of the coil. This as opposed to embodiments where the magnet is located inside the coil, thus requiring the magnet to be moved over the coil and thus out of the plane of the coil.

It is noted that in accordance with at least some exemplary embodiments herein, the implantable components herein can be exposed to at least a 2 T magnetic field or at least a 2.5 T or at least a 3 T or at least a 3.5 T magnetic field, without the magnetization and/or without effective movement of the implant as implanted in the recipient.

It is also noted that in an exemplary embodiment, instead of utilizing two or more magnets in the implantable component, in at least some exemplary embodiments, a single magnet is utilized in the implantable component, and one or more bodies of magnetic material that is not a magnet (e.g., ferromagnetic materials that are not a magnet) are instead utilized. That said, two or more magnets can be utilized and one or more of these non-magnet bodies can be utilized. In an exemplary embodiment, because two magnets are utilized in the external device, one magnet in the implantable device can be utilized to align the external component with the implantable component according to the teachings detailed herein, and the implanted body that is not a magnet can be utilized for retention purposes (and not alignment purposes, at least in some embodiments).

In an exemplary embodiment, there is a method, comprising holding an external component of a transcutaneous communication device including a first electromagnetic communication coil against skin of a recipient via a magnetic coupling extending from a first magnet outside the recipient to a second magnet implanted beneath the skin of the recipient, wherein with respect to a plane lying on a longitudinal axis extending between the first and second magnets, a 90 degree or more arcuate magnetic field path of the magnetic coupling extending in its entirety from a pole of the first magnet to a pole of the second magnet bypasses a second electromagnetic communication coil implanted in the recipient, wherein the first and second coils are substantially coaxial with one another. In an exemplary embodiment, there is a method as described above, wherein the external component includes a single magnet located off-center from the first electromagnetic communication coil of the external component that establishes in part the magnetic coupling, the magnet corresponding to the first magnet; and the single magnet orientates the external component so that the first and second coils are substantially coaxial with one another.

In an exemplary embodiment, there is an implantable medical device, comprising a magnet; and an electromagnetic communication wire forming, with respect to two dimensions, an enclosed boundary, wherein the magnet is located outside of the enclosed boundary. In an exemplary embodiment, there is an implantable medical device as described above and/or below, wherein the magnet is a first magnet; the device includes a plurality of second magnets located outside of the enclosed boundary, wherein in combination, the first magnet and the plurality of second magnets are arrayed about the wire in a substantially symmetrical manner. In an exemplary embodiment, there is an implantable medical device as described above and/or below, further comprising a receiver-stimulator, including: a receiver-stimulator electronics package; and a hermetically sealed housing, wherein the receiver-stimulator electronics package is located in the housing, and at least one of the magnet or a magnet assembly of which the magnet is a part is directly removably coupled to the housing. In an exemplary embodiment, there is an implantable medical device as described above and/or below, wherein the magnet is in-plane polarized.

It is noted that any method detailed herein also corresponds to a disclosure of a device and/or system configured to execute one or more or all of the method actions detailed herein. It is further noted that any disclosure of a device and/or system detailed herein corresponds to a method of making and/or using that the device and/or system, including a method of using that device according to the functionality detailed herein.

It is further noted that any disclosure of a device and/or system detailed herein also corresponds to a disclosure of otherwise providing that device and/or system.

It is noted that in at least some exemplary embodiments, any feature disclosed herein can be utilized in combination with any other feature disclosed herein unless otherwise specified. Accordingly, exemplary embodiments include a medical device including one or more or all of the teachings detailed herein, in any combination.

Note that exemplary embodiments include components detailed herein and in the figures that are rotationally symmetric about an axis thereof (e.g., the magnet apparatus 160). Accordingly, any disclosure herein corresponds to a disclosure in an alternate embodiment of a rotationally symmetric component about an axis thereof. Moreover, the exemplary embodiments include components detailed in the figures that have cross-sections that are constant in and out of the plane of the figure. Thus, the magnet apparatus 160 can correspond to a bar or box magnet apparatus, etc.).

While various embodiments of the present invention have been described above, it should be understood that they have been presented by way of example only, and not limitation. It will be apparent to persons skilled in the relevant art that various changes in form and detail can be made therein without departing from the spirit and scope of the invention.

What is claimed is:

1. An implantable medical device, comprising:
a ring-shaped magnet; and
a functional component of the implantable medical device, wherein at least one of:
the device is configured to enable the magnet to revolve; or
the functional component is an electromagnetic communication coil and the magnet extends about the coil.

2. The implantable medical device of claim 1, wherein:
the device is configured to enable the magnet to revolve.

3. The implantable medical device of claim 1, wherein:
the ring-shaped magnet is enclosed in a container,
the container is at least partially enveloped by a silicone body that supports the second coil, the container being a separate structure from the silicone body, and
the device is configured to enable the magnet to revolve in the container.

4. The implantable medical device of claim 1, wherein:
the container is ring-shaped, an interior of the container at least generally conforming to an exterior of the magnet.

5. The implantable medical device of claim 1, wherein:
the functional component is the electromagnetic communication coil; and
the magnet extends about the coil.

6. The implantable medical device of claim 1, wherein:
the magnet is in-plane polarized.

7. The implantable medical device of claim 1, wherein:
the container is ring-shaped, an interior of the container at least generally conforming to the exterior surfaces of the magnet, and the container hermetically seals the magnet therein.

8. The implantable medical device of claim 1, wherein:
the implantable medical device is magnetically coupled to an external component that includes a second magnet and a second coil extending about the second magnet, wherein with respect to a plane lying on a longitudinal axis extending between the magnet of the implantable medical device and the second magnet, a 90 degree or more arcuate magnetic field path of the magnetic coupling extending in its entirety from a pole of the magnet of the implantable medical device to a pole of the second magnet bypasses the coil of the implantable medical device, wherein the coil of the implantable medical device and the second coil are substantially coaxial with one another.

9. The implantable medical device of claim 1, wherein:

the implantable medical device is magnetically coupled to an external component that includes a second magnet and a second coil extending about the second magnet, wherein with respect to a plane lying on a longitudinal axis extending between the magnet of the implantable medical device and the second magnet, a 90 degree or more arcuate magnetic field path of the magnetic coupling extending in its entirety from a pole of the magnet of the implantable medical device to a pole of the second magnet does not bypasses the coil of the implantable medical device, wherein the coil of the implantable medical device and the second coil are substantially coaxial with one another.

10. A method, comprising:

holding an external component of a transcutaneous communication device including a first electromagnetic communication coil against skin of a recipient via a magnetic coupling extending from a first magnet outside the recipient to a second magnet implanted beneath the skin of the recipient, wherein with respect to a plane lying on a longitudinal axis extending between the first and second magnets, a 90 degree or more arcuate magnetic field path of the magnetic coupling extending in its entirety from a pole of the first magnet to a pole of the second magnet bypasses a second electromagnetic communication coil implanted in the recipient, wherein the first and second coils are substantially coaxial with one another.

11. The method of claim 10, wherein:

the second magnet is a first distance from the second coil;

a magnetic attraction force between the first and second magnets is a first value; and all other things being equal, an RF link efficiency is at least about 5% above that which would otherwise be the case if a portion of the arcuate magnetic field path extends through the second coil.

12. The method of claim 10, wherein:

the second magnet is a first distance from the second coil;

a magnetic attraction force between the first and second magnets is a first value; and all other things being equal, an RF link efficiency is at least about 10% above that which would otherwise be the case if a portion of the arcuate magnetic field path extends through the second coil.

13. The method of claim 10, further comprising:

subsequent to the action of holding the external component to the skin of the recipient, removing the second magnet from the recipient by detaching a magnet assembly of which the second magnet is apart from direct coupling with an implanted housing containing electronics and in signal communication with the second coil.

14. The method of claim 10, wherein:

the second magnet is a first distance from the second coil;

a magnetic attraction force between the first and second magnets is a first value; and all other things being equal, eddy current generation with respect to the magnet and the coil is at least about 50% below that which would otherwise be the case if a portion of the arcuate magnetic field path extends through the second coil.

15. The method of claim 10, further comprising:

wherein the second magnet is configured to revolve within a container implanted in the recipient.

16. The method of claim 10, wherein:

a plurality of second magnets are implanted in the recipient, and at least a plurality of the plurality of second magnets are spherical magnets.

* * * * *